United States Patent [19]

Boisvert et al.

[11] 4,379,293

[45] Apr. 5, 1983

[54] TRANSPARENT ADDRESSING FOR CRT CONTROLLER

[75] Inventors: Conrad Boisvert; William J. Greger, both of San Jose, Calif.

[73] Assignee: Honeywell Inc., Minneapolis, Minn.

[21] Appl. No.: 173,209

[22] Filed: Jul. 28, 1980

[51] Int. Cl.[3] ..... G09G 1/16

[52] U.S. Cl. ..... 340/750; 340/709; 340/814; 340/798; 340/707

[58] Field of Search ..... 340/709, 814, 707, 744, 340/748, 750, 798, 799, 802, 803

[56] References Cited

U.S. PATENT DOCUMENTS

| | | | |
|---|---|---|---|
| 3,997,891 | 12/1976 | Iwamura et al. | 340/709 |
| 4,203,107 | 5/1980 | Lovercheck | 340/709 |
| 4,274,081 | 6/1981 | Nomura et al. | 340/709 |

*Primary Examiner*—Marshall M. Curtis
*Attorney, Agent, or Firm*—Trevor B. Joike

[57] ABSTRACT

A controller for a CRT is disclosed having processor terminals for connecting the controller to a processor, CRT terminals for connecting the controller to a CRT, a refresh address generator for generating refresh addresses so that a display on the CRT can be refreshed, an update address generator for generating update addresses so that information in a refresh memory can be updated, refresh memory terminals for connecting the update address generator and the refresh address generator to a refresh memory, and a control circuit for exclusively connecting the update address generator and the refresh address generator to the refresh memory terminals so that only one of the generators has control of the refresh memory at a time.

37 Claims, 62 Drawing Figures

CCLK∝
D1
LD19
E1
F1
C1
B1
A1
R8Q2
G1
D0
D1
D2
D3
D4
D5
LD18
CLR
DT
P1
P2
UARC
T
LD
$\overline{LD}$
Q
$\overline{Q}$
U
V
W
X
Y
MA8
MA9
MA10
MA11
MA12
MA13
UPDATE
LOCATION
REGISTER 18

SCAN LINE
REGISTER 9

ADDRESS REGISTER

TEØS
RØW CØUNTER

RES
CØMPR 9
CØMPROA
CNTR RC
CI
C2
T
CLR
Q
Q̄
RCB̄0
RCB̄1
RCB̄2
RCB̄3
RCB̄4
RCB̄5
RCB̄6
R8Q2
E
CCLK
C̄C̄LK
+V
SYNC/VIDEØ
RCQO
51

VERTICAL DISPLAY REGISTER 6

VERTICAL SYNC WIDTH CØUNTER

VERTICAL SYNC, HØRIZØNTAL SYNC WIDTH REGISTER 3

TEØS
COMPRØ A
SYNC VIDEØ
SCAN LINE
CØUNTER

CI
CNTR
C2
T
CLR
Q̄
Q
SCB̄0
G
SCB̄1
H
SCB̄2
I
SCB̄3
J
SCB̄4
CCLK
CCLK
CØMPRO A
CØMPR 9
TEØS
RES
ØDD
SYNC VIDEØ
K

CURSØR PØSITIØN
REGISTER 14

LIGHT PEN
REGISTER 16

TRANSPARENT ADDRESSING FOR CRT CONTROLLER

BACKGROUND OF THE INVENTION

The present invention relates to a controller for Cathode Ray Tubes and, more particularly, to a controller which allows transparent addressing of the refresh RAM.

In operating a CRT (Cathode Ray Tube), the codes of the characters to be projected by the electron beam onto the CRT screen are typically stored in a RAM memory. Since the characters projected on the screen by the electron beam decay with time, the CRT controller must periodically take each of the characters out of the RAM memory and use them to control the electron beam for reprojecting the characters onto the screen. This operation is known as refresh, i.e. refreshing the screen display. Each character or portion thereof is thus put on the screen as the electron beam travels across each individual line of the screen.

Additionally, because the information stored in the RAM to be projected on the screen must be periodically changed as conditions change, the information stored in the RAM must be updated. Updating is accomplished by addressing the memory locations of the RAM and inserting the new data into those memory locations. The memory must be updated as often as new data is generated.

Thus, not only must the RAM be addressed for refreshing the screen display but it must also be addressed for updating the stored information.

A primary function of the CRT controller is to constantly retrieve characters from the RAM and to control the video generation circuit of the CRT to display these characters so that the screen display stays active. Therefore, the CRT controller must have access to the RAM. A difficulty arises, however, since the microprocessor or other computer to which the controller is connected must also have access to the RAM for update. The prior art solved the problems of this dual addressing requirement by the use of a memory contention circuit. The typical memory contention circuit of prior CRT controller arrangements comprised an address multiplexer which could receive an address from either the CRT controller or the microprocessing unit. The address multiplexer, of course, required control circuitry so that it could be switched between the microprocessor and the CRT controller. Moreover, this type of system also required transceivers between the control arrangement and the data bus so that the characters to be read into or out of the RAM could be held and then read or written. The use of a memory contention circuit requires the microprocessor to provide the update address during the update operation placing a further burden on the microprocessor operation.

The present invention eliminates the memory contention circuit, i.e. the external multiplexer required to multiplex between the update address supplied by the microprocessor and the refresh address supplied by the CRT controller together with the associated control circuitry for the multiplexer and the transceivers for receiving data between the microprocessor and the RAM, and also relieves the microprocessor of the burden of providing the update addresses for the RAM. Instead, an update address register is provided in the CRT controller to thus provide the update addresses to the RAM so that data can be transferred from the microprocessor to the RAM directly without requiring the microprocessor to additionally address the RAM memory locations. In this type of operation, the RAM appears as a port to the microprocessor instead of a block of memory which must be addressed. As a result, the present invention provides truly transparent addressing of the refresh RAM.

SUMMARY OF THE INVENTION

A controller for CRTs is provided having an update address generator for generating update addresses when new information is to be inserted into memory associated with the CRT, a refresh address generator for addressing the memory to fetch characters for refreshing the display on the CRT, and a control circuit for exclusively connecting the generators to the memory so that only one of the generators is connected to the memory at a time.

BRIEF DESCRIPTION OF THE DRAWINGS

These and other features and advantages will become more apparent from a detailed consideration of the invention when taken in conjunction with the drawings in which:

FIGS. 2–45 show the details of the CRT Controller 10 shown in FIG. 1 wherein FIGS. 2–7 show the Refresh Address Generator of Controller 10, FIG. 8 shows how the circuits of FIGS. 2–7 may be assembled to show the Refresh Address Generator, FIGS. 9 and 10 show the Update Location Registers 18 and 19 which together form the Update Address Generator of Controller 10, FIG. 11 shows the controller circuit for the Update Location Registers 18 and 19, FIG. 12 shows the ROM Control Line Generator, FIG. 13 shows the Scan Line Register 9 of Controller 10, FIG. 14 shows the Mode Control Register 8 of Controller 10, FIG. 15 shows the DISPEN Signal Generator of Controller 10, FIG. 16 shows the CURSOR Signal Generator of Controller 10, FIG. 17 shows the RAM Address Buffer of Controller 10, FIGS. 18 and 19 show the Address Register which is used to load in information on the data bus into the various registers of Controller 10, FIG. 20 shows the Data Bus Interface between the microprocessor data bus and the internal data bus of Controller 10, FIG. 21 shows the Column Counter of Controller 10, FIG. 22 shows the Horizontal Display Register 1 of Controller 10, FIG. 23 shows the Horizontal Sync Position Register 2 of Controller 10, FIG. 24 shows the Horizontal Total Register 0 of Controller 10, FIG. 25 shows the Row Counter of Controller 10, FIG. 26 shows the Vertical Display Register 6 of Controller 10, FIG. 27 shows the Vertical Sync Position Register 7 of Controller 10, FIG. 28 shows the Vertical Total Register 4 of Controller 10, FIG. 29 shows the Vertical Sync Width Counter of Controller 10, FIGS. 30 and 31 show the Vertical Sync, Horizontal Sync Width Register 3 of Controller 10, FIG. 32 shows the Scan Line Counter of Controller 10, FIG. 33 shows the Cursor Start Register 10 of Controller 10, FIG. 34 shows the Cursor End Register 11 of Controller 10, FIG. 35 shows the Vertical Total Adjust Register 5 of Controller 10, FIGS. 36 and 37 show the Cursor Position Registers 14 and 15 of Controller 10, FIGS. 38 and 39 show the Light Pen Registers 16 and 17 of Controller 10, FIG. 40 (sheet 7) shows the Status Register of Controller 10, FIG. 41 (sheet 11) shows the Load 16 and 17 Signal Generator of Controller 10, FIG. 42 shows the Character Clock Signal Generator of Controller 10, FIG. 43 shows the Register Select and Chip Select Signal Generator of Controller 10, FIG. 44 shows the OEN and the OEN Signal Generator of Controller 10, and FIG. 45 shows the Read/Write Signal Generator of Controller 10; and, FIGS. 46–62 show the details of the various blocks of FIGS. 2–45 wherein

DETAILED DESCRIPTION

Figure 1:
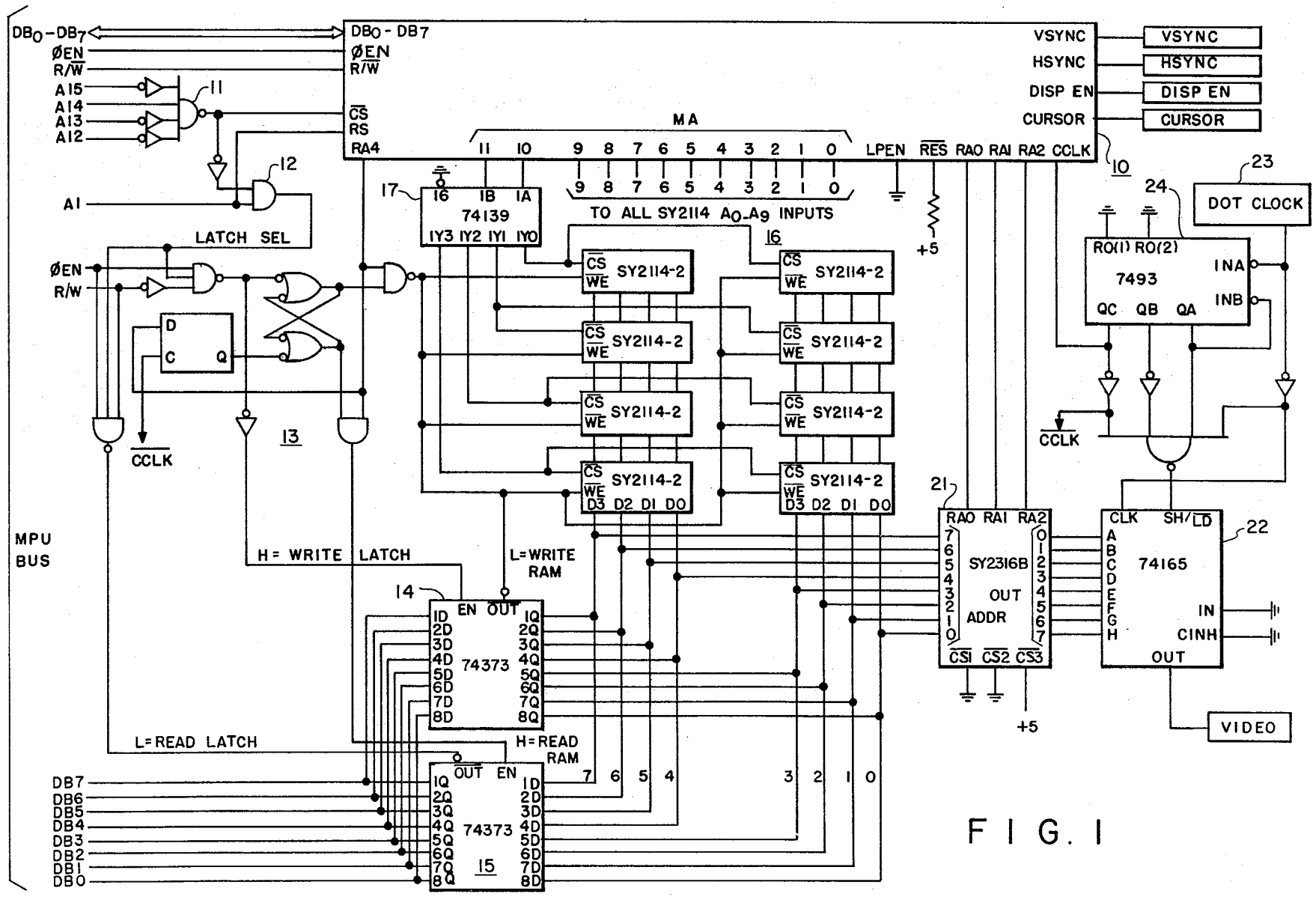
FIG. 1 is a generalized block diagram showing how the instant invention interfaces with both a microprocessor and a CRT.
Figure 2:
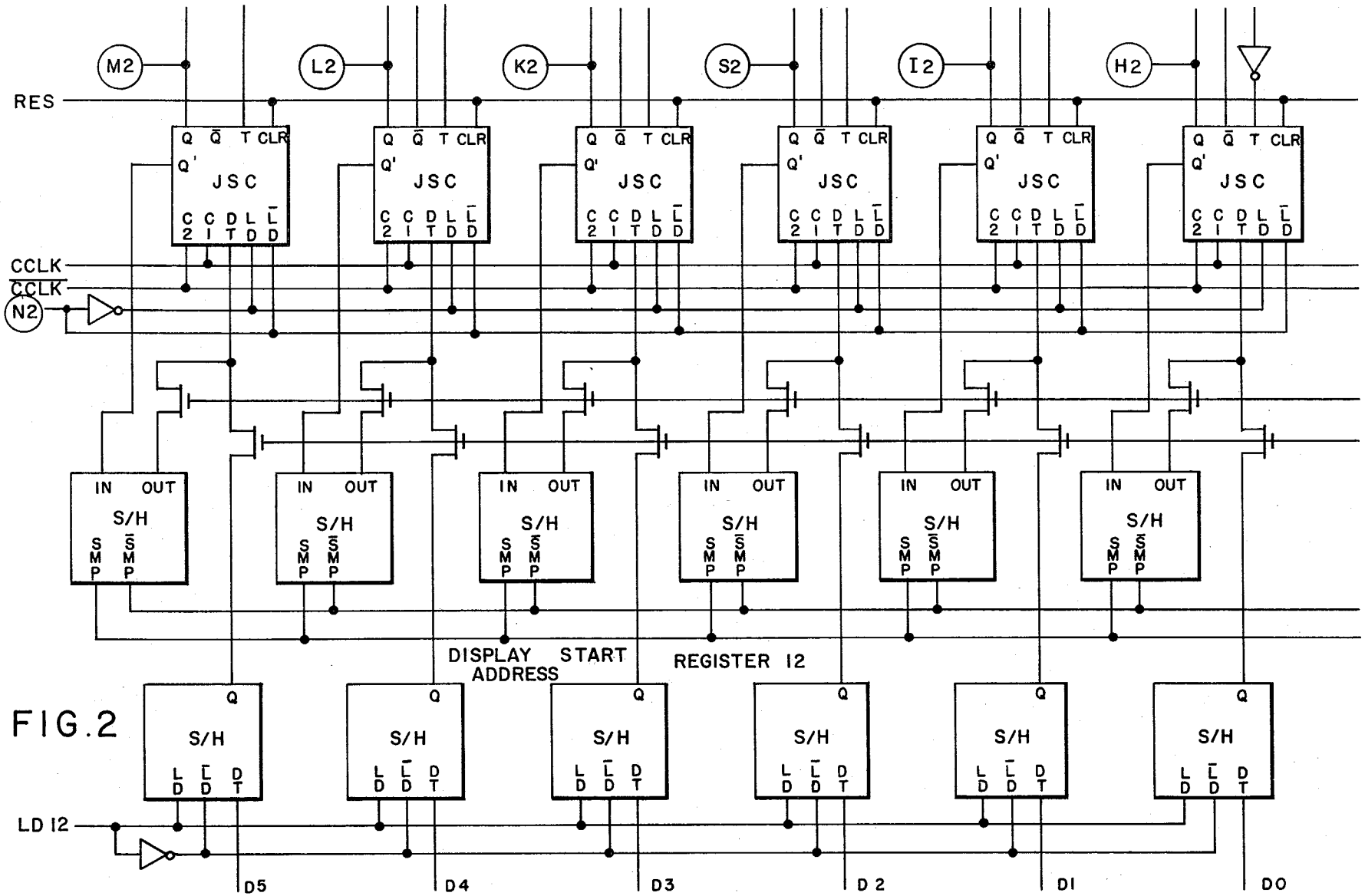
Figure 3:
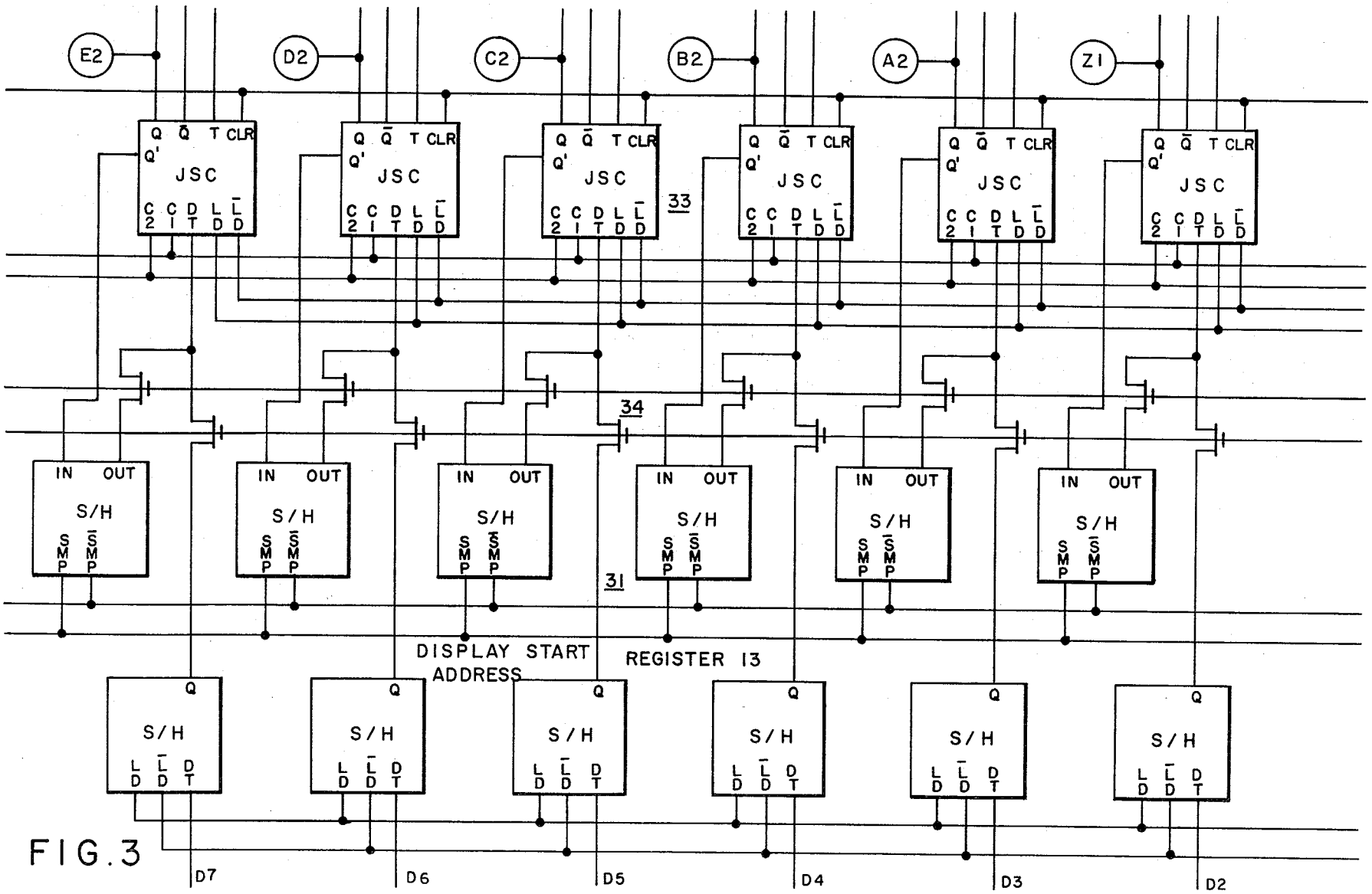

In FIG. 1, CRT controller 10 is shown connected to various external circuits for allowing microprocessor control of a CRT. Specifically, controller 10 is connected to the microprocessor by way of the data bus, the microprocessor clock $\phi$EN, the read/write control line R/$\overline{W}$, and address lines A1 and A12–A15. NAND gate 11 combines address lines A12–A15 into a chip select signal $\overline{CS}$. In addition, $\overline{CS}$ and address line A1 are combined by AND gate 12 to form a LATCH SELECT output which, together with $\phi$EN and R/W, are used as inputs by the logic circuit 13 for controlling data latches 14 and 15 connected between RAM 16 and the microprocessor data bus. Latch 14 is used for writing information into RAM 16 and latch 15 is used for reading RAM 16. Controller 10 also has an input RS, register select, connected to input address line A1.

Ram 16 is comprised of eight 1K×4 random access memories as shown. Each memory is connected to the memory address output lines MA0–MA9 of controller 10 so that the various memory locations in RAM 16 can be addressed. Memory addres lines MA10 and MA11 are decoded at 17 and are also used for controlling RAM 16. Controller 10 has an output RA4 connected to logic 13 for controlling reach latch 15.

The remaining connections to controller 10 are between controller 10 and the CRT which is being controlled by the circuit shown in FIG. 1. Specifically, outputs RA0–RA2 are used for controlling read only memory 21 which receives its codes (addresses) from the data stored in random access memory 16. Specifically, read only memory 21 stores the dot matrix representing the characters to be displayed by the CRT. RAM 16 stores the addresses of ROM 21 for the characters to be displayed by the CRT. Thus, the outputs from the ROM are connected to the inputs of parallel-to-serial shift register 22. Parallel-to-serial shift register 22 receives a clock signal from dot clock 23 of the CRT and receives further clock signals from four bit counter 24. The output from parallel-to-serial shift register 22 is connected to the VIDEO input of the CRT under control of the circuit of FIG. 1. Four bit counter 24 also provides the character clock outputs CCLK and $\overline{CCLK}$. Further as shown, the reset input $\overline{RES}$ is connected to a positive source, the light pen terminal LPEN is grounded, the vertical and horizontal sync outputs VSYNC and HSYNC are connected to appropriate inputs to the CRT, and the display enable output DISPEN and the CURSOR output from controller 10 are appropriately connected to the CRT circuit.

In operation, when the display on the CRT is to be refreshed, RAM 16 is addressed using lines MA0–MA9 for supplying the addresses of ROM 21 representing the characters to be displayed to parallel-to-serial shift register 22 and then to the CRT. When new information is to be written into RAM 16, address lines MA0–MA11 are under control of controller 10 which are driven by clock line $\phi$EN. Since clock line $\phi$EN is derived from the microprocessor, the microprocessor is updated as to the present output on address lines MA0–MA9. At the appropriate time, the microprocessor will supply data over the data bus to write RAM 14 and then, by control of address lines A1 and A12–A15, and read/write line R/$\overline{W}$, will transfer the data from latch 14 into the memory location of RAM 16 selected by the address on lines MA0–MA9.

Figure 8:
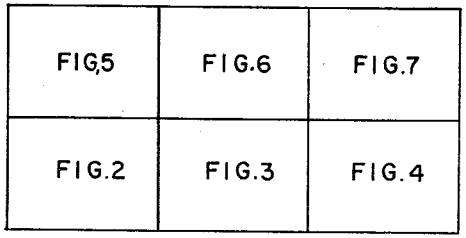
Figure 7:
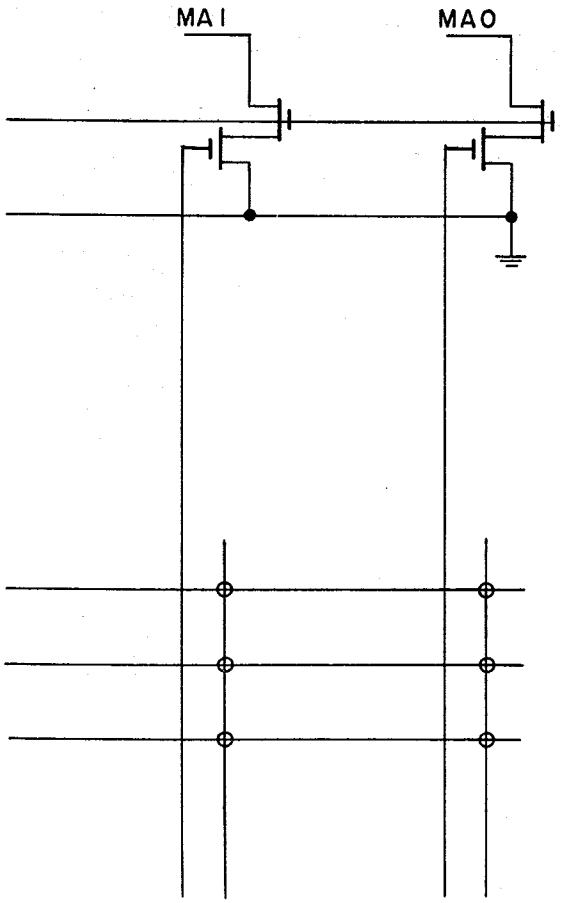

FIGS. 2–45 show the details of controller 10. As previously mentioned, controller 10 supplies both the addresses for refreshing the display on the CRT and the addresses for updating RAM 16. For the refresh operation, FIGS. 2–7 show the refresh address generator and FIG. 8 shows how FIGS. 2–7 are to be arranged for following the connections between these figures. The refresh address generator comprises registers 12 and 13 with register 12 being connected to data lines D0–D5 and register 13 being connected to data lines D0–D7 running throughout FIGS. 2–45. The information loaded into registers 12 and 13 determine the initial address in RAM 16 which acts as a pointer to indicate in the RAM the start point of the message to by displayed. The information on data lines D0–D7 is loaded into registers 12 and 13 by load lines LD12 and LD13, respectively, as shown. Sample and hold array 31 (FIG. 3) recirculates data from the output of the jam set counters JSC back to their input. This operation is under control of the character clock and the outputs from registers 1 and 9 as shown by NOR gate 32 shown in FIG. 4. The information from registers 12, 13 and sample and hold array 31 are multiplexed into the jam set counter array 33 under control of the multiplexer transistor array 34.

Figure 4:
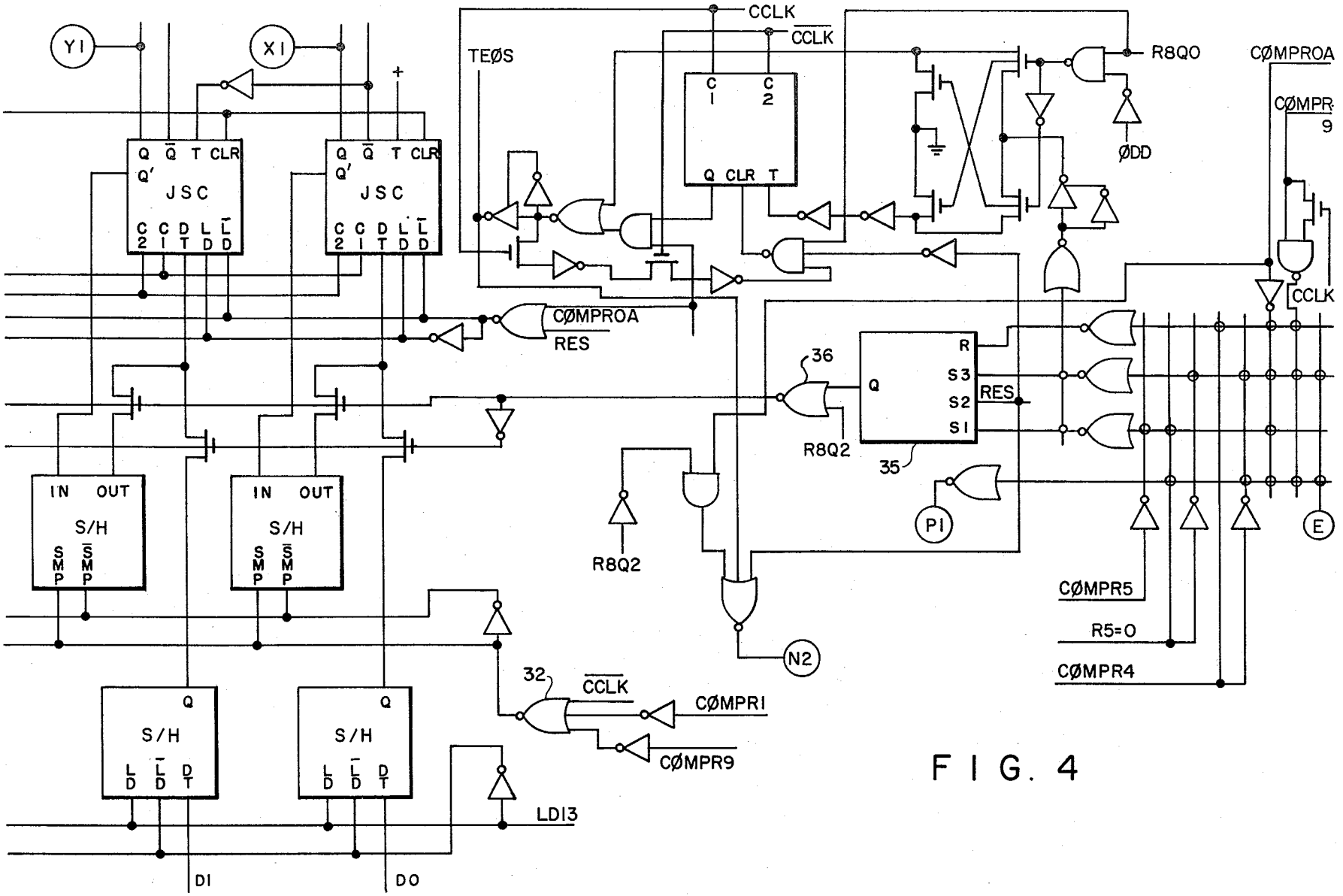
Figure 5:
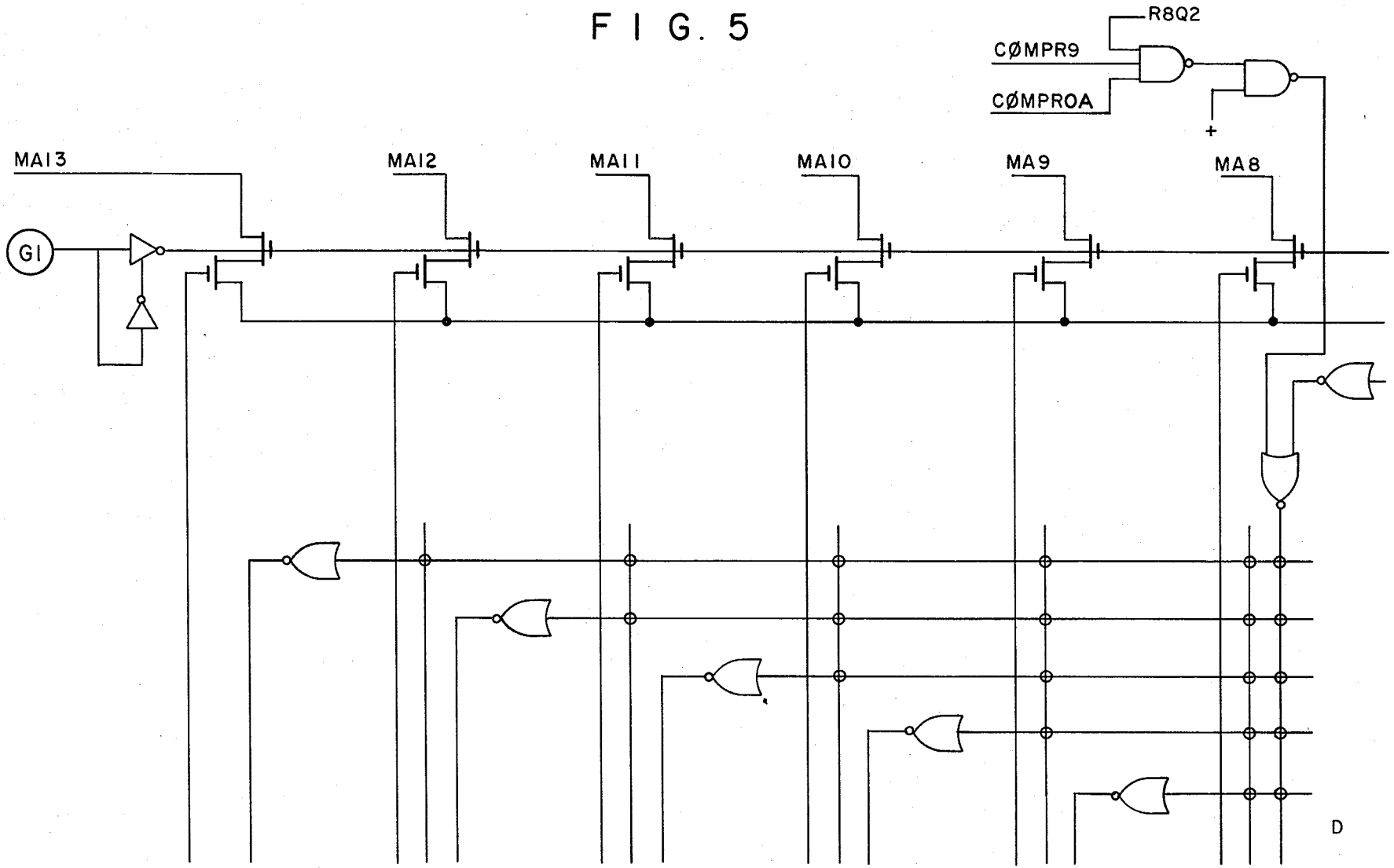
Figure 6:
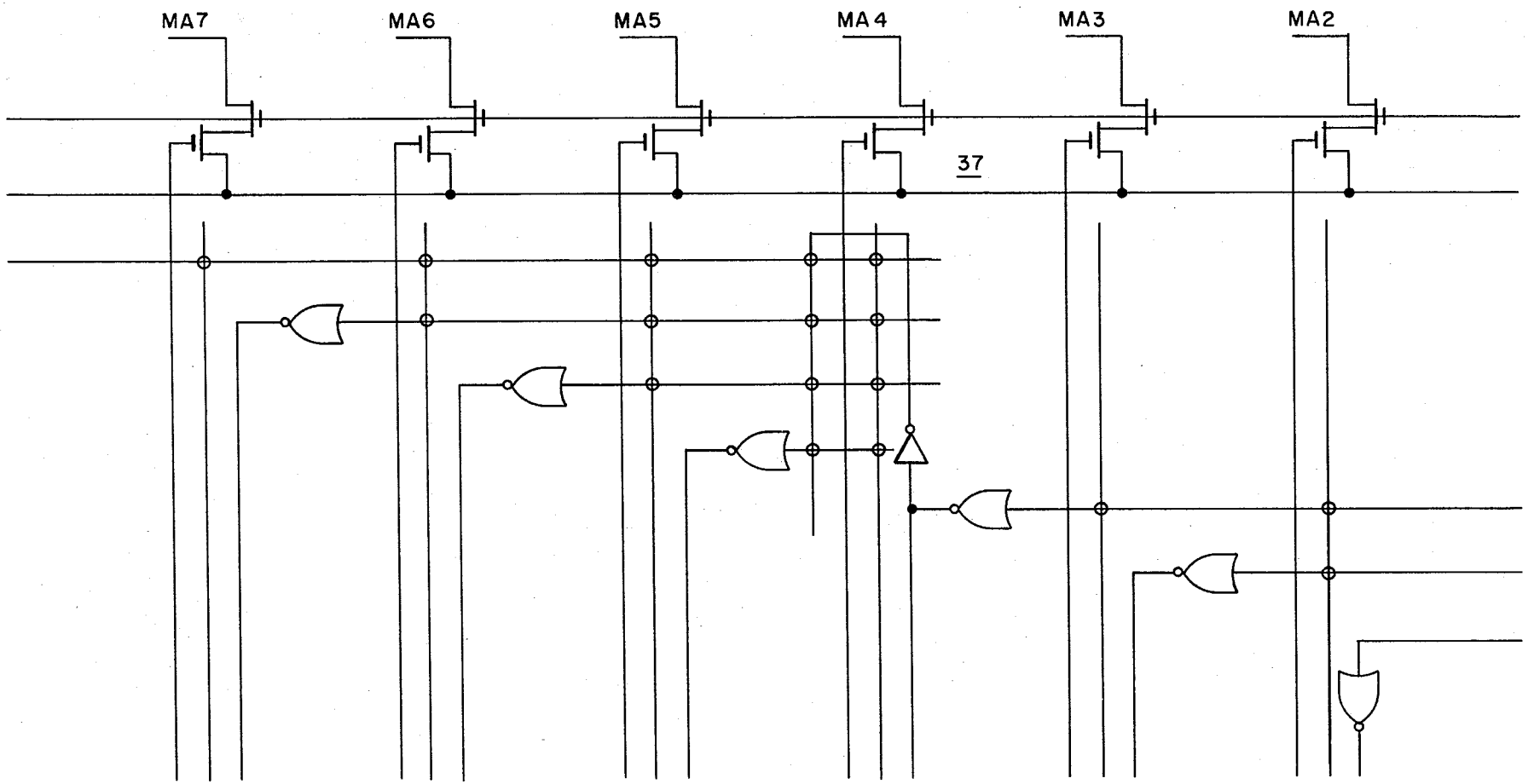

This transistor array is under control of the mode control register R8 output R8Q2 and the set/reset circuit 35 which is set and reset from the various registers and the character clock as shown in FIG. 4. Essentially, the output from set/reset circuit 35 and line R8Q2 initialize the jam set counter 33 for each scan line of the CRT. Thus, for each scan line, NOR gate 36 provides an appropriate output for transferring the data stored in registers 12 and 13 to the jam set counter 33. Specifically, jam set counter 33 begins with the count initialized into it from registers 12 and 13 and counts character clock pulses. Each time transistor array 37 is energized by terminal G1 shown in FIG. 5, the count from jam set counter 33 is supplied to the memory address bus MA0–MA13. The address on memory address bus MA0–MA13 from refresh address generator shown in FIGS. 2–7 are then used for addressing RAM 16 to supply characters to the CRT for displaying and for refreshing the display on the screen. Also, FIG. 4 shows how the TEϕS signal is generated during the last clock time of the last scan line of the display.

Figure 9:
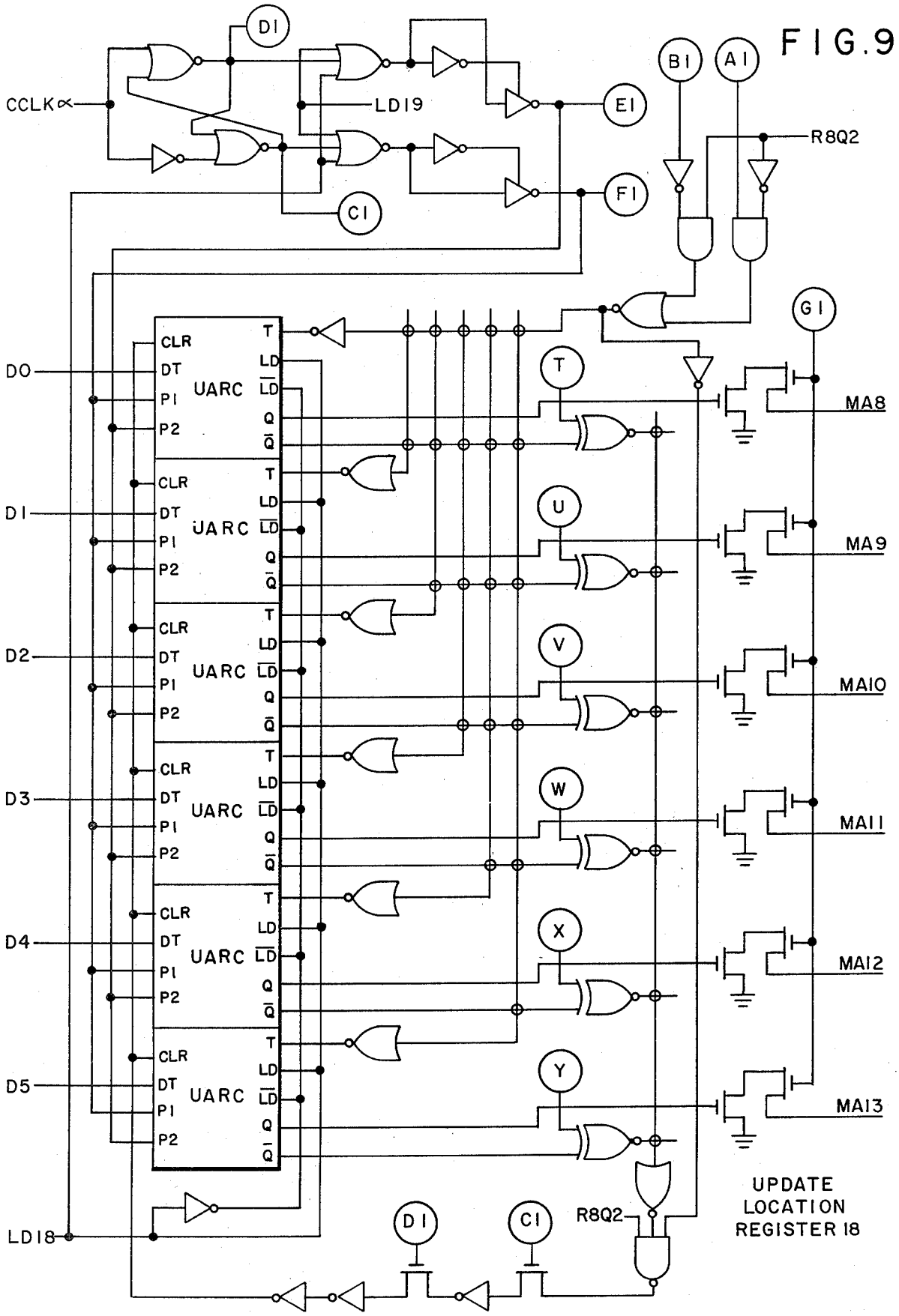
Figure 10:
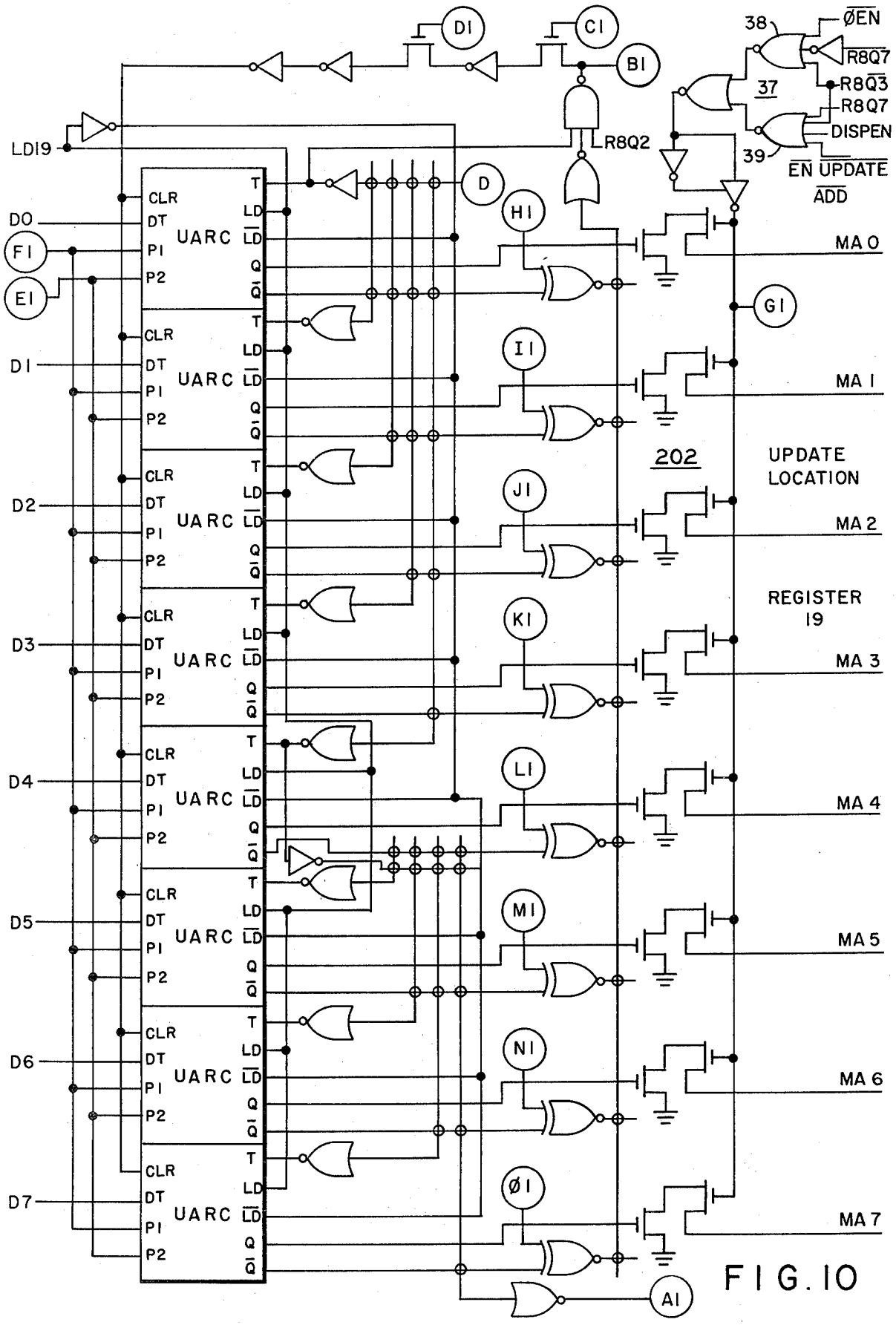

FIGS. 9 and 10 show the update location registers 18 and 19 which together form the update address generator. The counter blocks in the registers 18 and 19 are connected to the internal data bus D0–D7 so that registers 18 and 19 can be loaded with a beginning address from the microprocessor. However, once the beginning address has been loaded into registers 18 and 19 and the transparent addressing mode has been selected, the counters which make up registers 18 and 19 will begin counting character clock pulses under control of the toggle input T at terminal D as shown in FIG. 10. The toggle signal provided at terminal D is supplied by the circuit shown in FIG. 11.

The controller 10 has essentially two modes of operation for transparent addressing. In the interleaved mode, update address generator shown in FIGS. 9 and 10 will be outputted during half cycles of a first polarity of the ϕEN clock signal and the refresh address generator will be outputted during the other polarity half cycles of the microprocessor clock signal ϕEN.

The second mode of transparent addressing is the retrace transparent addressing mode. During this mode, updating occurs during the blanking of the electron beam. That is, the electron beam of the CRT is turned off or blanked for non-display intervals. Blanking occurs when the signal DISPEN is at a logic '0' (ground).

Figure 11:
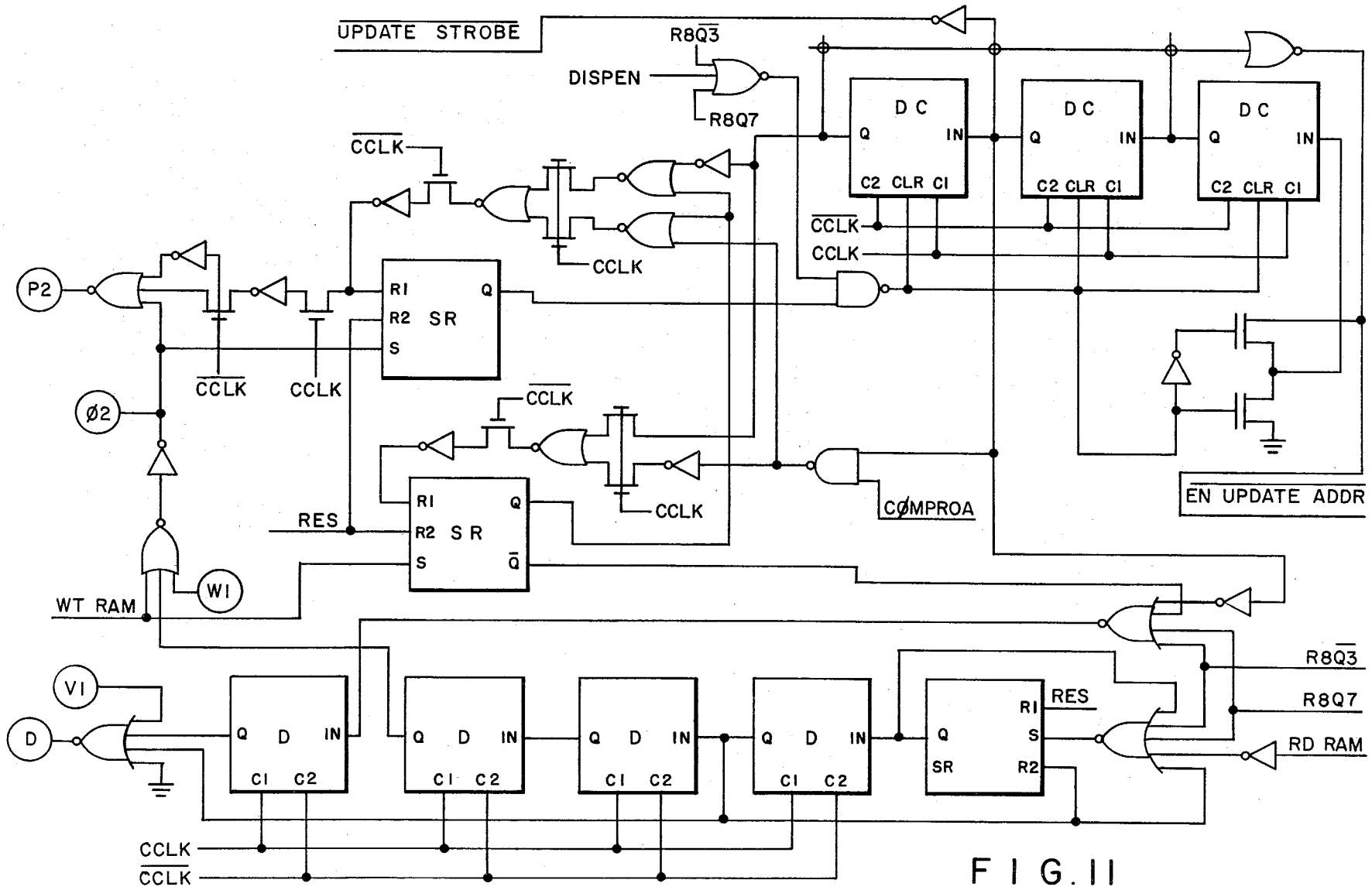

The circuit shown in FIG. 11 provides a different toggling output at terminal D depending on which transparent addressing mode is selected. Furthermore, logic circuit 37 of FIG. 10 responds to the designated outputs from mode register R8, microprocessor clock signal $\overline{\phi EN}$, the display enable signal DISPEN and the enable update address signal $\overline{EN\ UPDATE\ ADDR}$ for controlling the supply of the count from registers 18 and 19 to the memory address bus MA0–MA13 through the respective transistor arrays 201 and 202. Specifically, in logic circuit 37, NOR gate 38 is active during the interleaved mode and NOR gate 39 is active during the retrace mode. If neither mode is selected, then a memory contention circuit has to be used and logic 37 does not allow the counter registers 18 and 19 to supply a count to the memory address bus MA0–MA13.

FIG. 9 shows how the circuit uses the character clock signal for generating the clocking signals of the counters which make up registers 18 and 19. The toggling input allows these counters to count the pulses supplied to their count terminals P1 and P2. As mentioned previously, if transparent addressing has not been selected for controller 10, logic 37 is disabled to prevent registers 18 and 19 from supplying addresses to the memory address bus MA0–MA13. If the interleaved mode of transparent addressing is selected for controller 10, NOR gate 38 receives appropriate inputs from mode selection register 8 for passing the microprocessor clock signal $\overline{\phi EN}$ to the transistor array associated with registers 18 and 19 to supply the addresses generated by the counter to the memory address bus. Thus, in the half cycles of the same polarity of this clock signal, the addresses from the counters are supplied to the memory address bus. If the retrace mode of operation for transparent addressing is selected for controller 10, mode selection register 8 conditions NOR gate 39 for passing the $\overline{EN\ UPDATE\ ADDR}$ signal to the transistor array for supplying the output count from the counter to the memory address bus. In this operation, this count is supplied to the memory address bus only during horizontal or vertical blanking.

At the same time that an address is being supplied to the memory address, the microprocessor is transferring data to the write data latch 14 so that this data can be transferred to the memory location represented by the address on the memory address bus MA0–MA13. Thus, RAM 16 can be updated with new information. Moreover, the circuit in FIG. 11 generates the $\overline{UPDATE\ STROBE}$ signal as shown.

Figure 12:
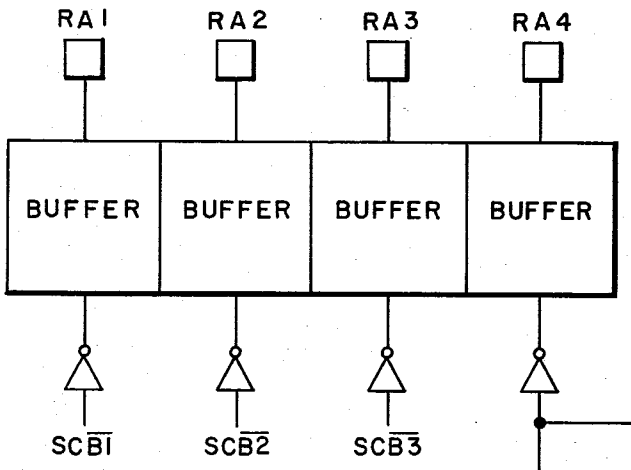
Figure 13:
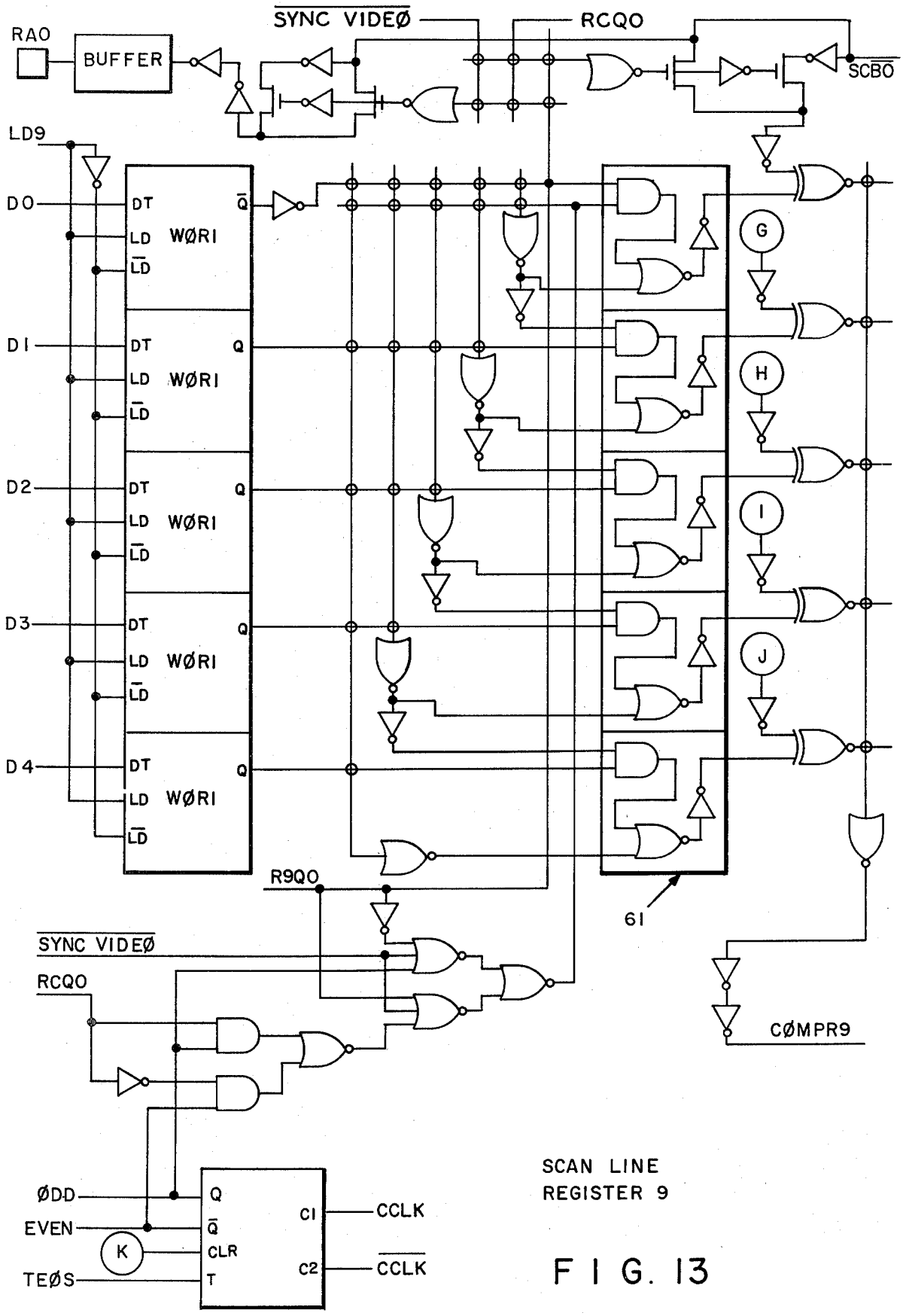

The $\overline{UPDATE\ STROBE}$ signal is connected to FIG. 12 which, with FIG. 13, shows how the ROM control lines RA0–RA4 are generated. As shown in FIG. 1, only RA0–RA2 are used for controlling ROM 21. However, two additional lines RA3 and RA4 are available dependent upon the type of ROM selected. In FIG. 1, RA3 is not used and RA4 will provide the $\overline{UPDATE\ STROBE}$ signal which is used by logic 13 for controlling RAM 16 and read latch 15.

Figure 14:
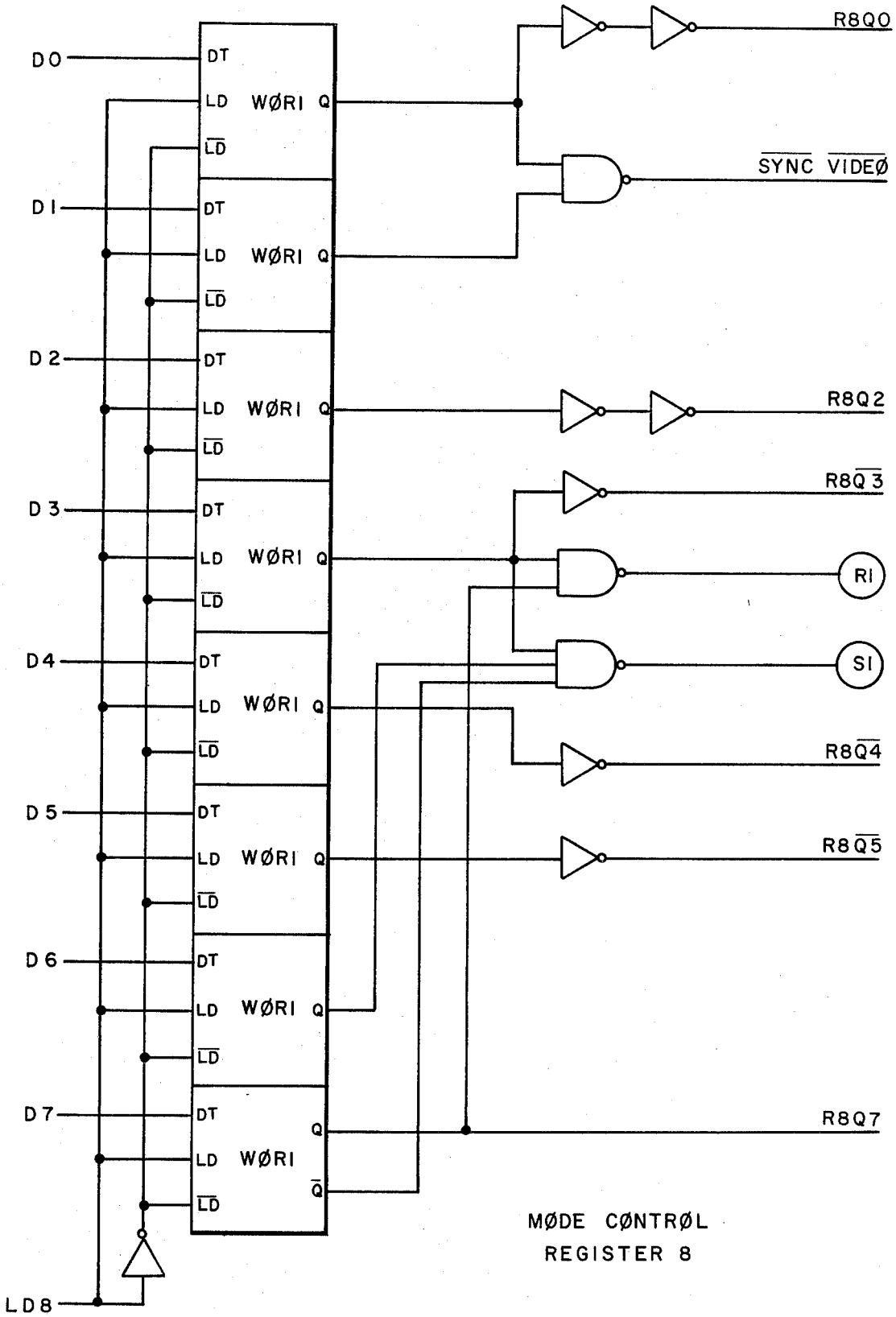
Figure 15:
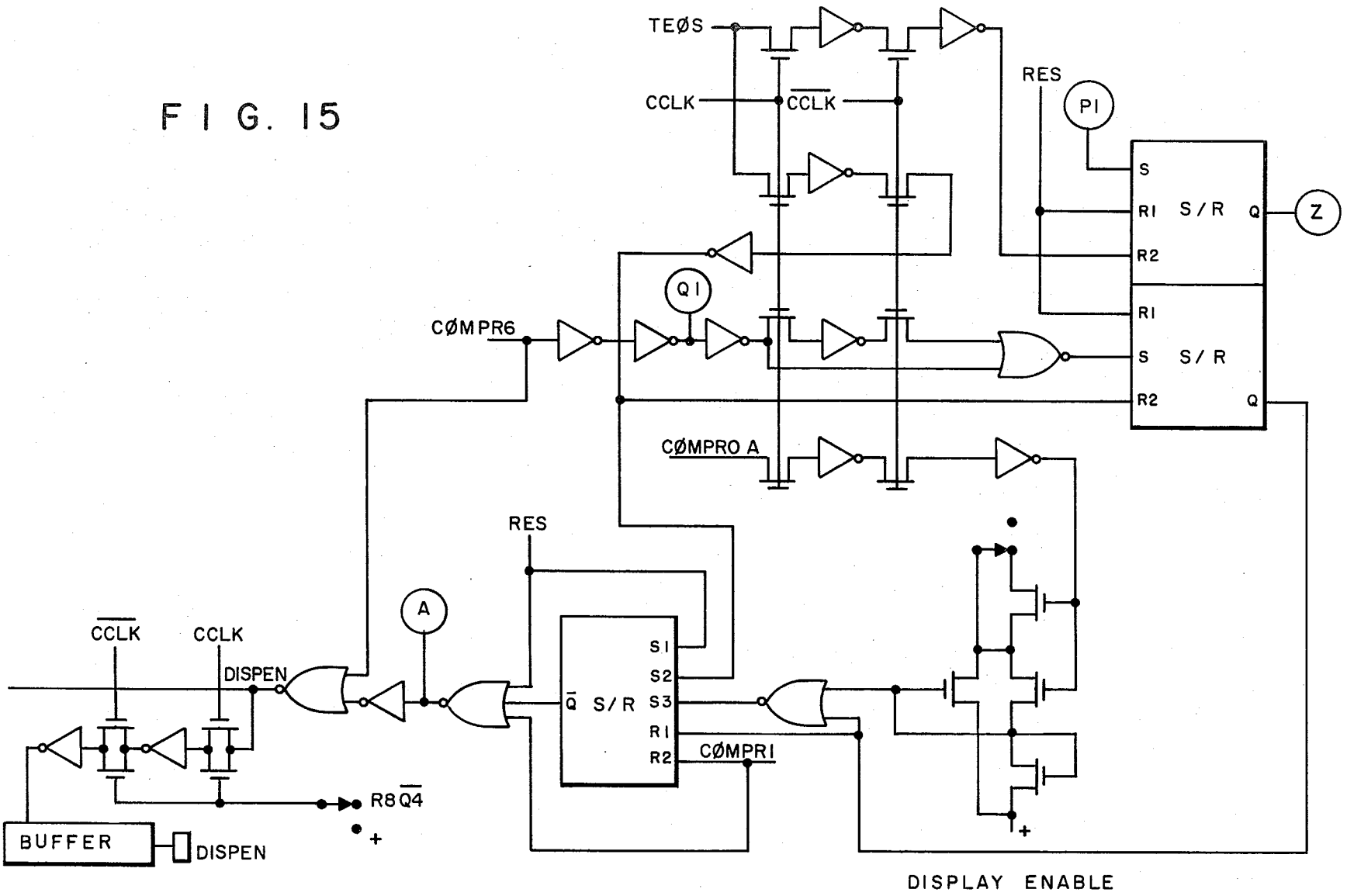

FIG. 14 shows the mode control register 8 in more detail. The inputs for this register are connected to the internal data bus D0–D7 of controller 10 and provide the various outputs as shown. Outputs R8Q0 and $\overline{SYNC\ VIDEO}$ designate whether or not the interlace mode for CRT operation is selected. In this operation there are basically three modes. In the non-interlace mode, each scan line is refreshed at the vertical field rate. In the interlace scan modes, even and odd fields alternate to generate frames for displaying characters of information. The horizontal and vertical timing relationship causes the scan lines in the odd field to be displaced from those in the even fields. There are two raster scan display modes for the interlace mode. When the interlace-sync mode is to be used, the same information is to be displayed in both odd and even fields. Enhanced readability results because the spaces between the adjacent rows are filled and a higher quality character is displayed. The interlace sync and video mode is used to double the character density on the screen by displaying the even lines in even fields and the odd lines in odd fields.

The R8Q2, R8Q3, and R1 outputs of FIG. 14 are used for addressing and accessing the refresh RAM. Outputs R8Q7 and R8Q3 are used for the transparent/non-transparent mode selection. Output S1 is used to determine whether or not output RA4 is used as a ROM control line or for providing an UPDATE STROBE signal.

Output R8$\overline{Q5}$ determines whether the cursor should be skewed by one character time. This output is shown as an input to FIG. 16 for providing the one character time delay of the CURSOR signal. Output R8$\overline{Q4}$ determines whether the display enable signal should be delayed one character time for skewing the display. This output is shown as an input to FIG. 15 for providing the one character time delay for the display enable signal DISPEN.

Figure 17:
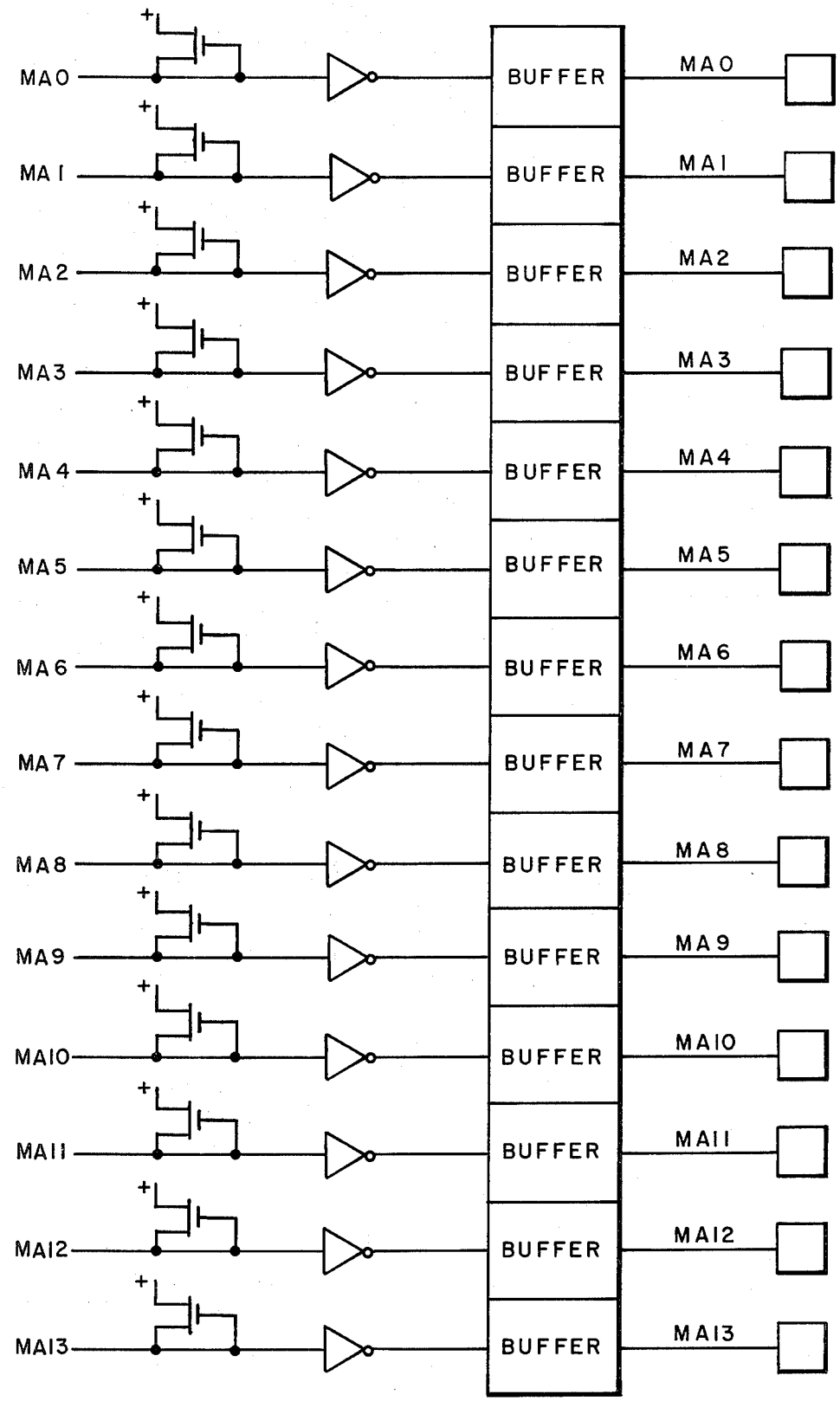

FIG. 17 shows the internal MA0–MA13 bus connected through pull-up transistors and buffers to provide the output lines MA0–MA13 from controller 10 as shown in FIG. 1.

Figure 18:
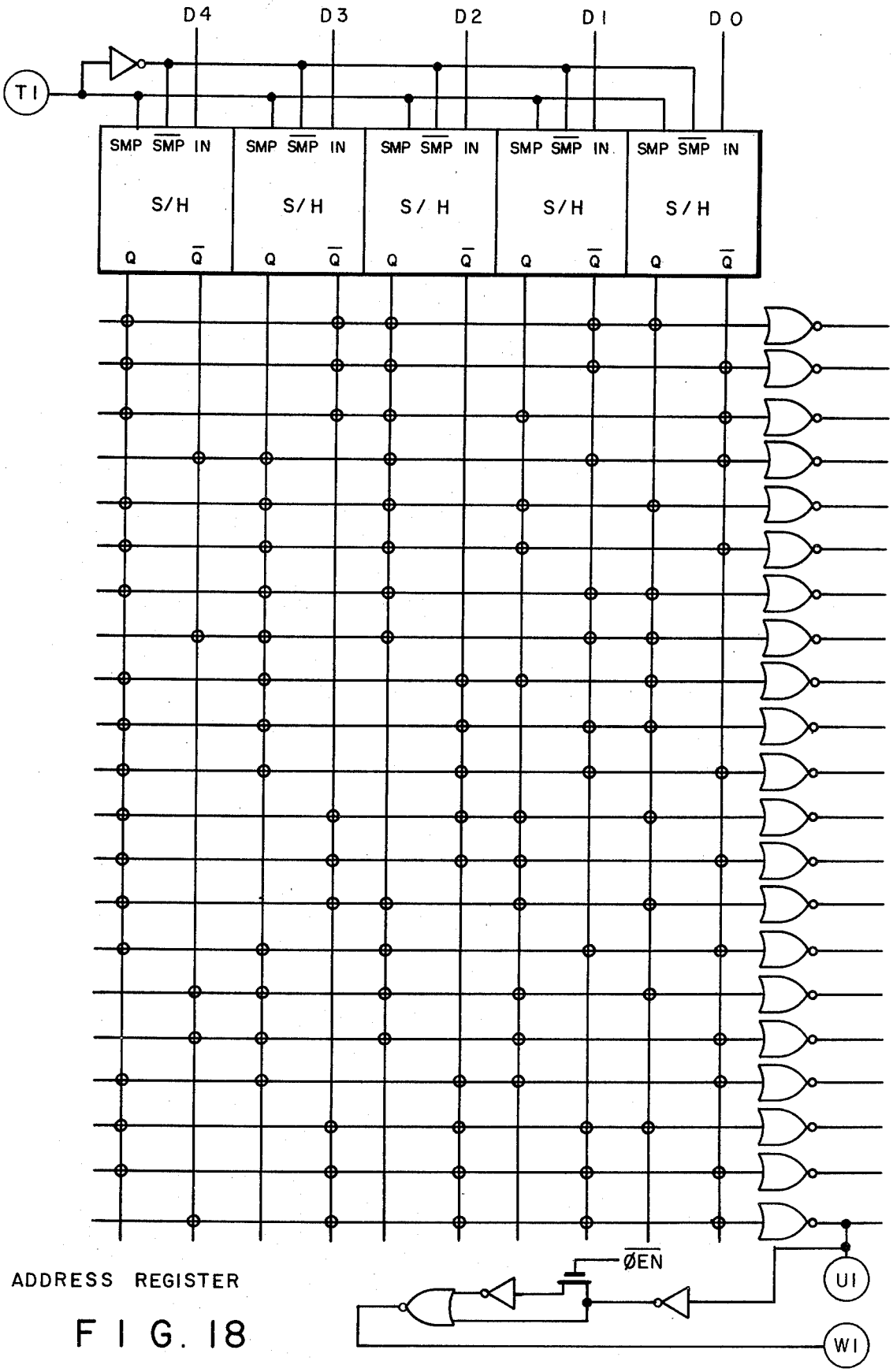
Figure 19:
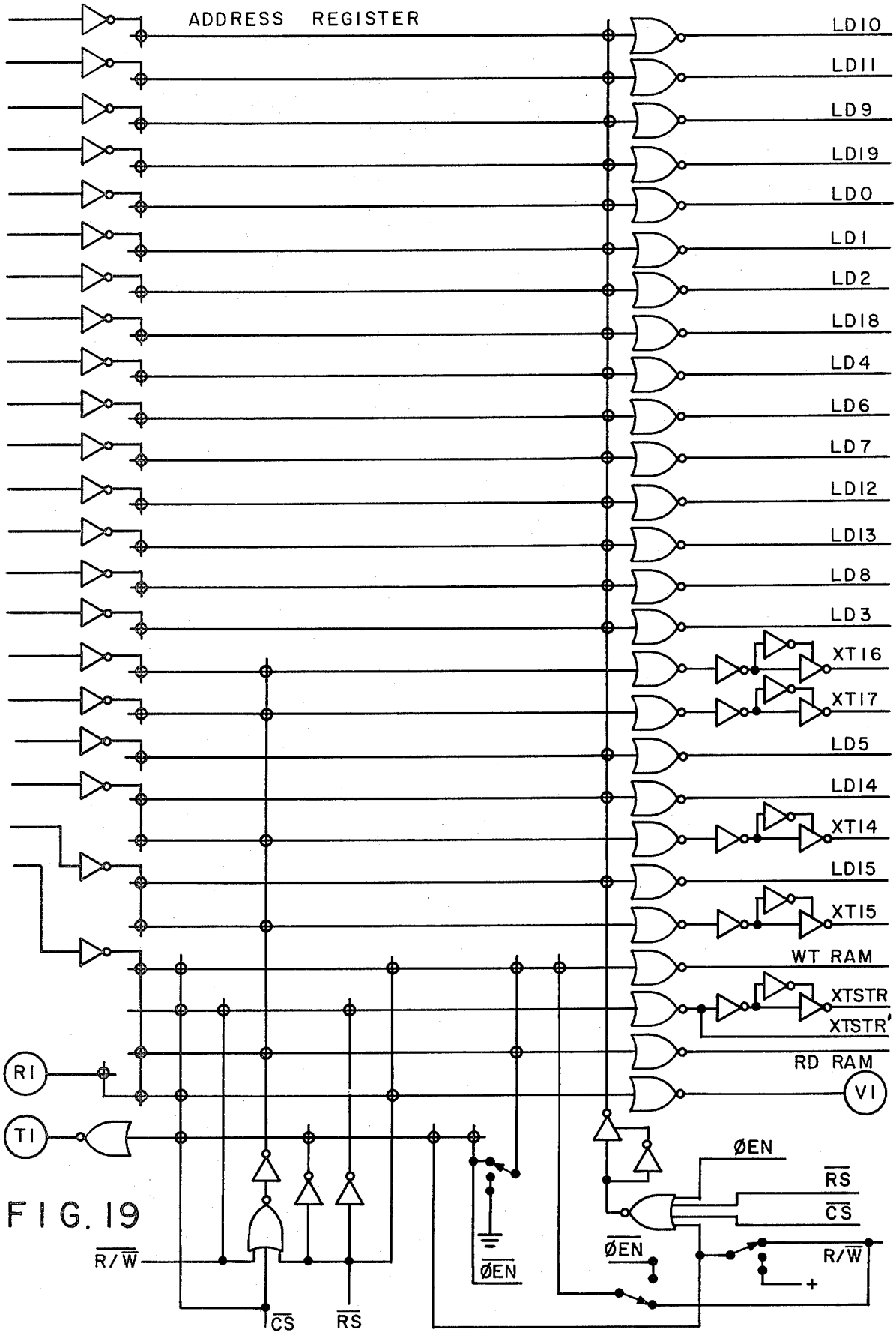

The address register which provides the various load LD signals, exit XT signals, write and read RAM signal is shown in FIGS. 18 and 19 which, if laid side by side with FIG. 18 on the left, show how the two halves of the address register fit together. The exit XT signals are used to read the information from the various registers controlled by XT inputs.

Figure 20:
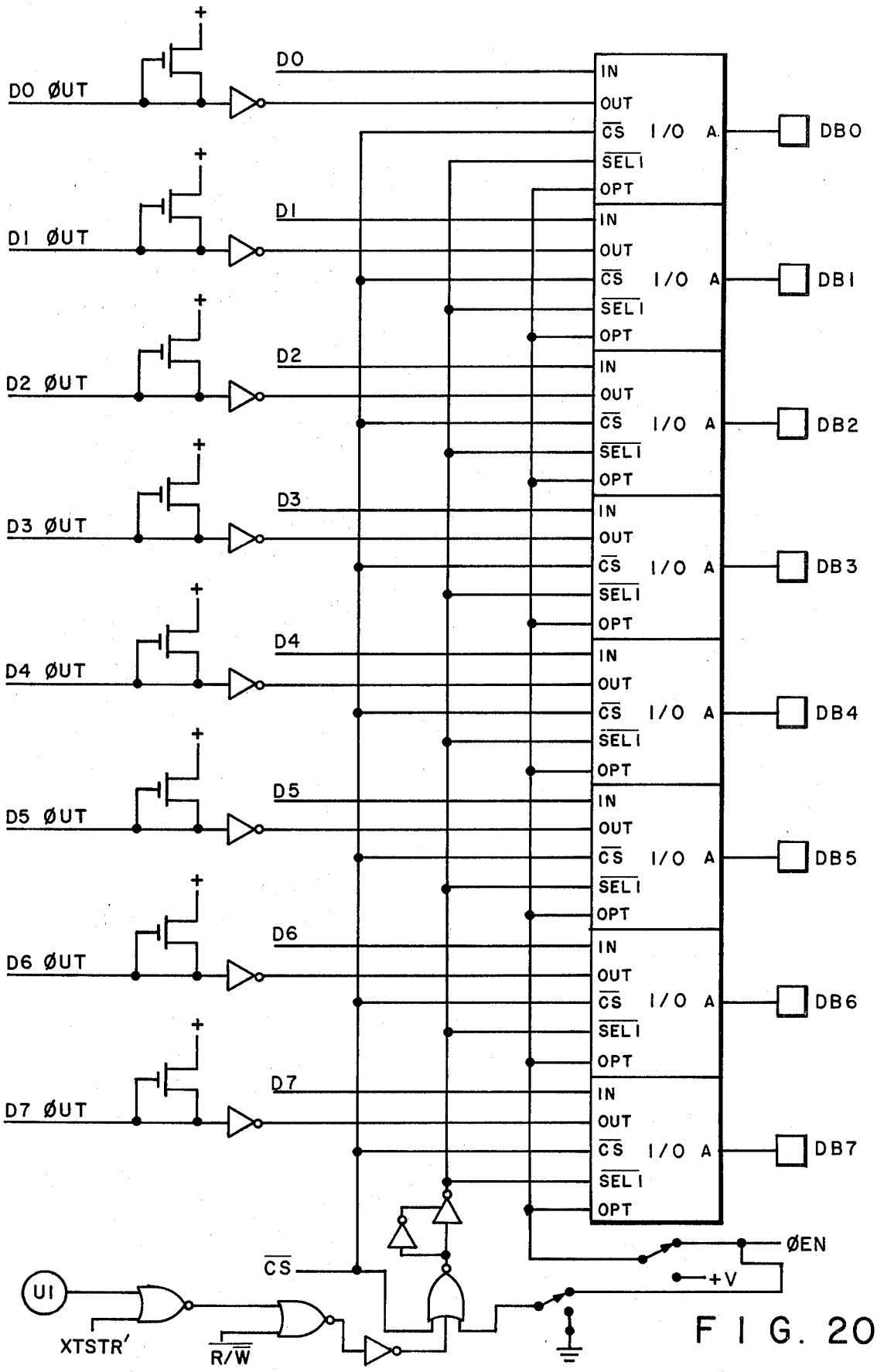

The interface between the microprocessor data bus and the internal data bus of controller 10 is shown in FIG. 20. The internal data-out bus D0–D7 is shown connected to corresponding outputs of the input/output blocks which are connected to the microprocessor data bus DB0–DB7. Internal data bus D0–D7 is the input data bus to the registers of controller 10. In addition, controller 10 is capable of providing data to the microprocessor data bus DB0–DB7. This internal outgoing data bus of controller 10 is shown as D0 $\phi$UT–D7 $\phi$UT and is provided with pull-up transistors and appropriate connections to the corresponding inputs of the input-/output blocks. These input/output blocks are under control of the read/write input $\overline{R/W}$ for controlling the direction of data flow through the input/output blocks, the chip select input $\overline{CS}$ for enabling the input/output blocks when controller 10 is selected by the microprocessor, and the exit status register signal XTSTR'.

The above essentially describes the portions of the circuit relating to transparent addressing mode of operation of controller 10, although later described circuits will have some control of the transparent mode of operation. The remainder of controller 10 will now be described functionally by reference to the various counters and registers which make up controller 10.

Figure 21:
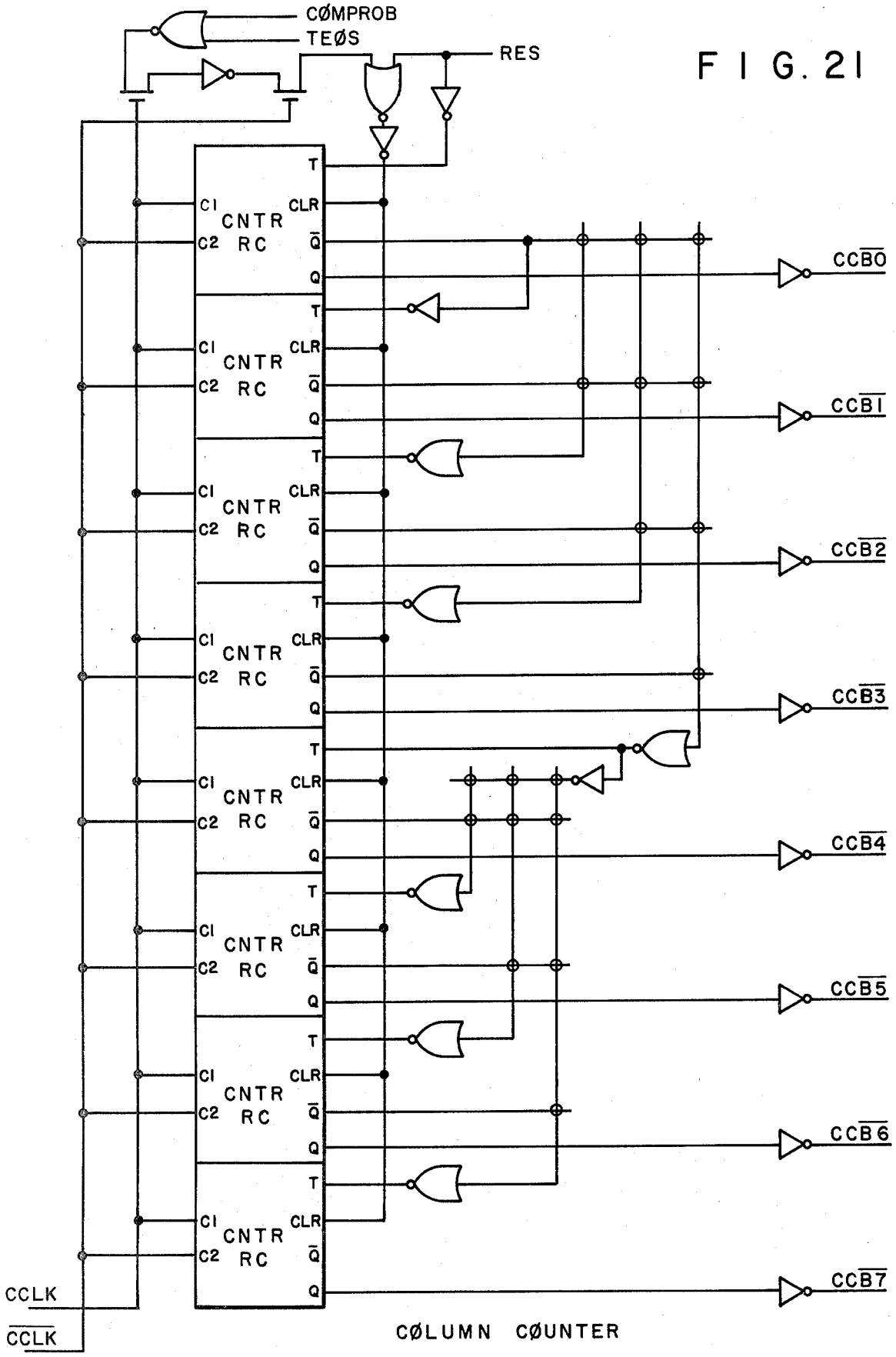

The column counter is shown in FIG. 21 and is comprised of a plurality of counter blocks operating off of the character clock as shown. In addition, the output from register 0, C$\phi$MPROB, the toggle signal which is produced at the end of the screen, TE$\phi$S, and the reset signal RES are combined for clearing the counter after the number of columns on the CRT screen have been counted. When the reset signal is '0' or non-active, the column counter is allowed to count; otherwise, when the reset signal is '1' or active, the column counter is inhibited from counting. The column counter essentially divides the screen into a predetermined number of columns within which the characters can be displayed. The outputs from the column counter shown in FIG. 21 are CC$\overline{B0}$–CC$\overline{B7}$.

Figure 22:
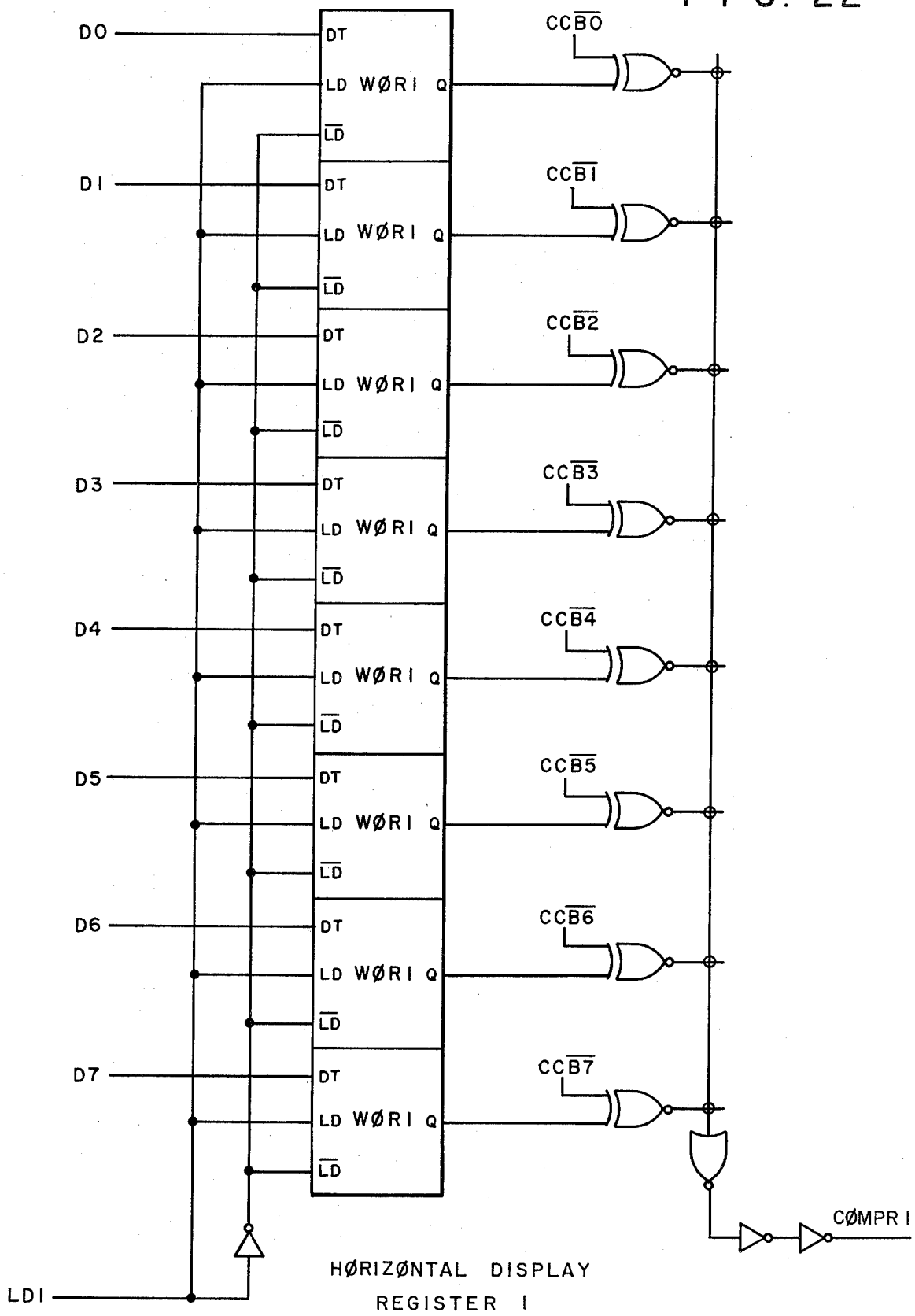

These outputs from the column counter are provided as inputs to the EXCLUSIVE NOR array shown in FIG. 22. FIG. 22 shows the HORIZONTAL DISPLAY REGISTER 1 which is an 8-bit register containing the number of displayed characters per horizontal line. The number inputted to register 1 by internal bus D0–D7 represents the number of characters which are to be displayed on the horizontal line of the screen relative to the total number of characters which are possible to display on the screen. The EXCLUSIVE NOR array then compares the number stored in register 1 with the count from the column counter shown in FIG. 21 for providing the output signal C$\phi$MPR1 which is used to control the sample and hold register of the refresh address generator and is also used to tell the monitor when the electron beam should be blanked.

Figure 23:
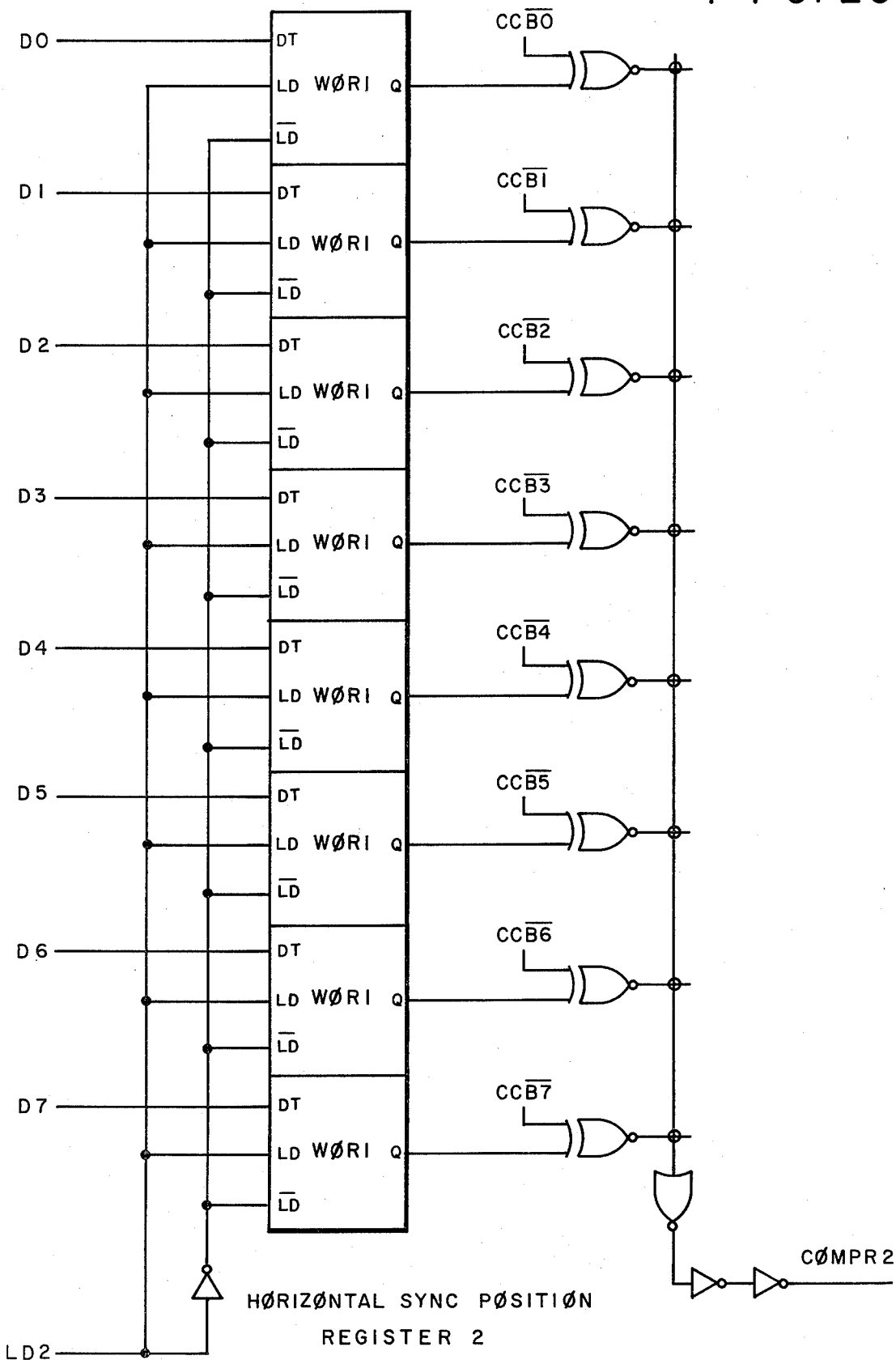

The outputs CCB0–CCB7 are also connected to the inputs of the EXCLUSIVE NOR gates shown in FIG. 23. FIG. 23 shows HORIZONTAL SYNC POSITION REGISTER 2 comprised of a plurality of write-only-registers having inputs from the internal data bus D0–D7 for accepting inputs from the microprocessor representing the position of the HSYNC on the horizontal line in terms of the character location number on the line. The position of the HSYNC determines the left-to-right location of the displayed text on the video screen. In this way, the side margins are adjusted. In other words, this register determines when the electron beam is swept back to the left. The outputs from the EXCLUSIVE NOR gates are used to form the C$\phi$MPR2 signal which is used to provide the HSYNC output from controller 10.

Figure 24:
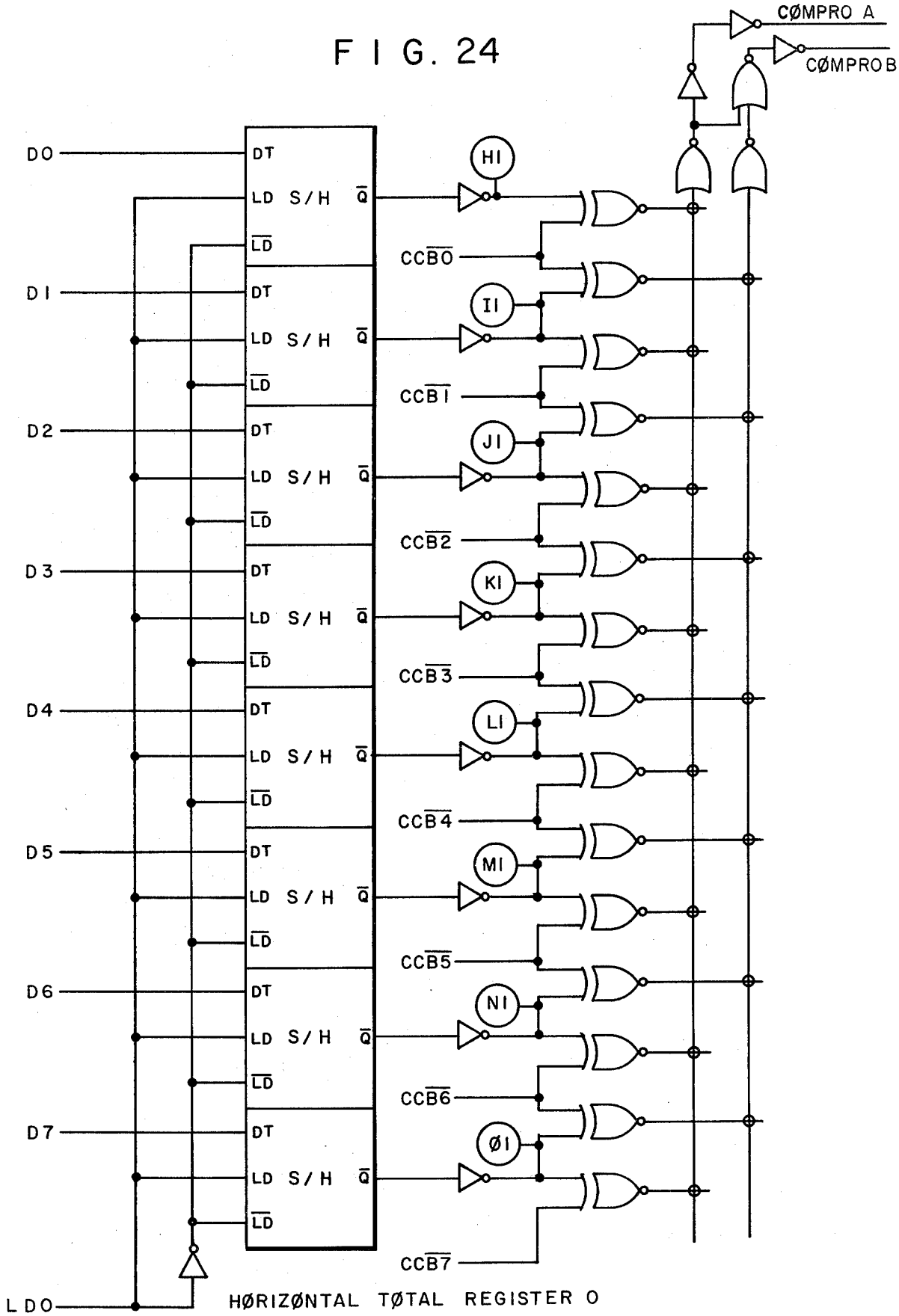

Finally, outputs CC$\overline{B0}$–CC$\overline{B7}$ are connected to a plurality of EXCLUSIVE NOR gates shown in FIG. 24 which gates also receive input from the sample and hold registers forming HORIZONTAL TOTAL REGISTER 0. The sample and hold circuits are connected as shown to the internal data bus D0–D7 for receiving an input from the microprocessor. This register is an 8-bit register which contains the total of displayed and non-displayed characters, minus one, per horizontal line. The frequency of HSYNC is thus determined by this register. In other words, this register determines the maximum number of characters which are possible to be displayed from left to right, and receives an input from the microprocessor for tailoring it to the particular CRT associated with controller 10. This register provides a plurality of outputs. Output C$\phi$MPROA is used for providing the toggle and clear inputs to the counters as shown in the drawings. Thus, the NOR gate array compares the total of displayed and non-displayed characters contained in the sample and hold registers of register 0 to the column count supplied by CC$\overline{B0}$–CC$\overline{B7}$ so that the various counters can be cleared and toggled at the end of a line scan. Likewise, the output C$\phi$MPROB is used also for clearing and toggling. Register 0 also provides a plurality of outputs H1–O1 for use by register 19 for comparing the count output from register 19 to generate a toggling signal for register 18, and a clear signal for register 19.

Figure 25:
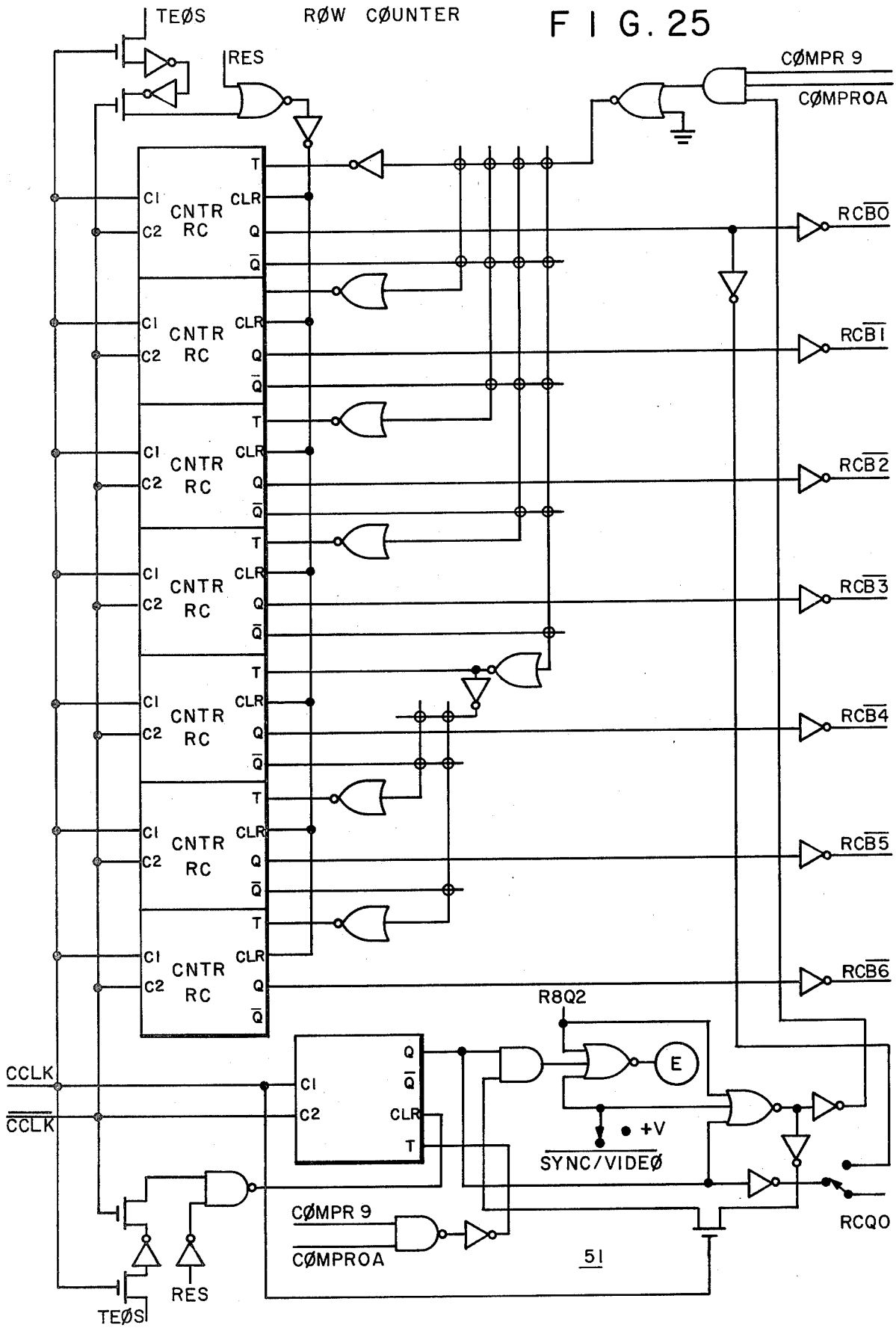

In FIG. 25 there is shown the ROW COUNTER which is clocked by the character clock and toggled by a composite of C$\phi$MPR9, C$\phi$MPROA and logic 51. This counter provides the count output RC$\overline{B0}$–RC$\overline{B6}$ and is used to divide or partition the screen into rows. Thus, the combination of the COLUMN COUNTER and the ROW COUNTER divides or partitions the CRT screen into an X/Y matrix or grid. A single character may be displayed within each square of the grid.

Figure 26:
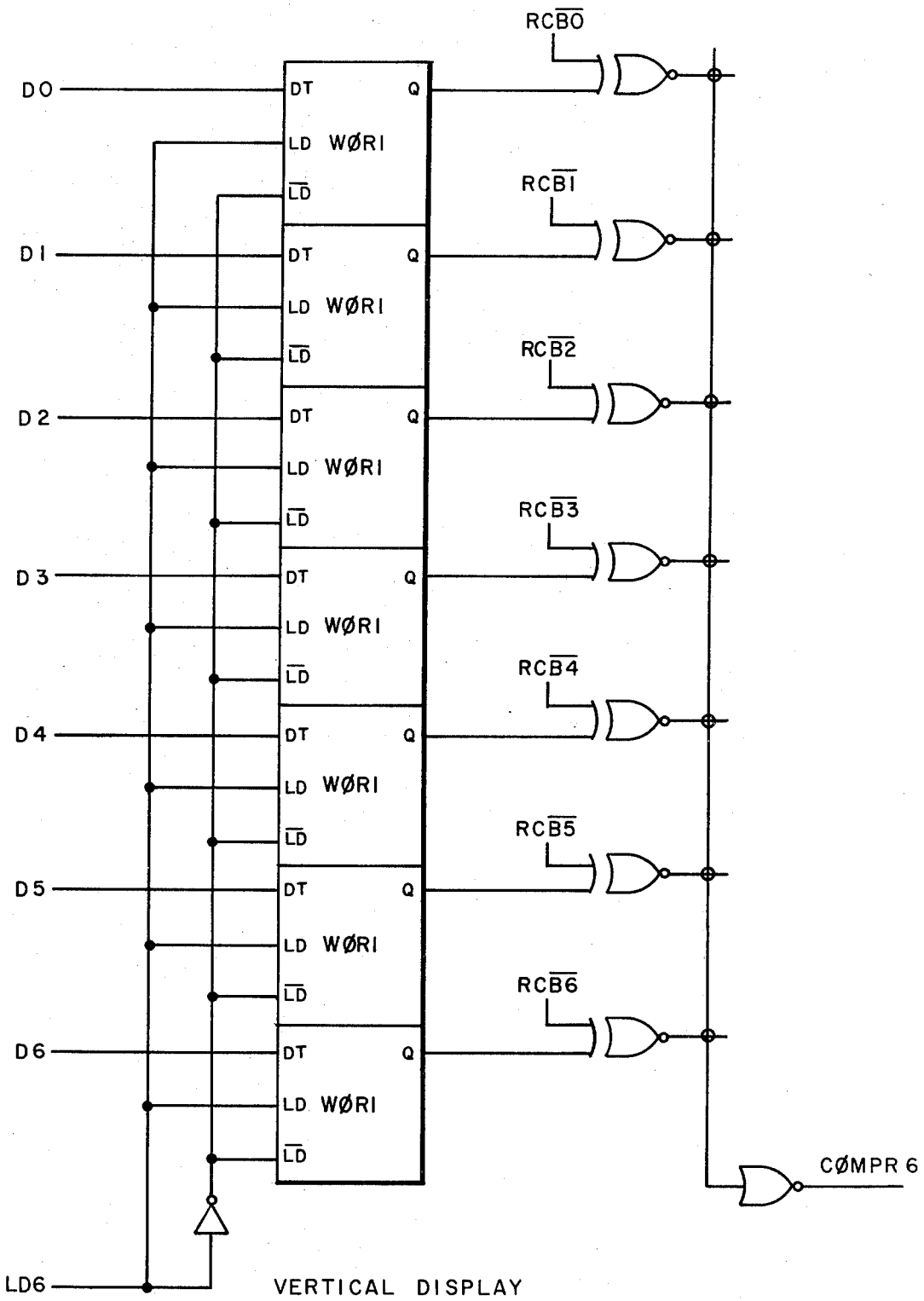

The outputs RC$\overline{B0}$–RC$\overline{B6}$ from the ROW COUNTER shown in FIG. 25 are used as inputs to the EXCLUSIVE NOR gate array shown in FIG. 26. This EXCLUSIVE NOR gate array is part of the VERTICAL DISPLAY REGISTER 6 which is also comprised of a plurality of write-only-registers as shown receiving inputs over lines D0–D6 of the internal data bus. Register 6 is a 7-bit register containing the number of displayed character rows in each frame. In this way, the vertical size of the displayed text is determined. In essence, this register determines the number of rows that are to be displayed relative to the total number of rows which are possible to be displayed. This register forms the output CϕMPR6 which is used to generate the display enable output DISPEN and is also used to input the 3-bit status register to be described hereinafter.

Figure 27:
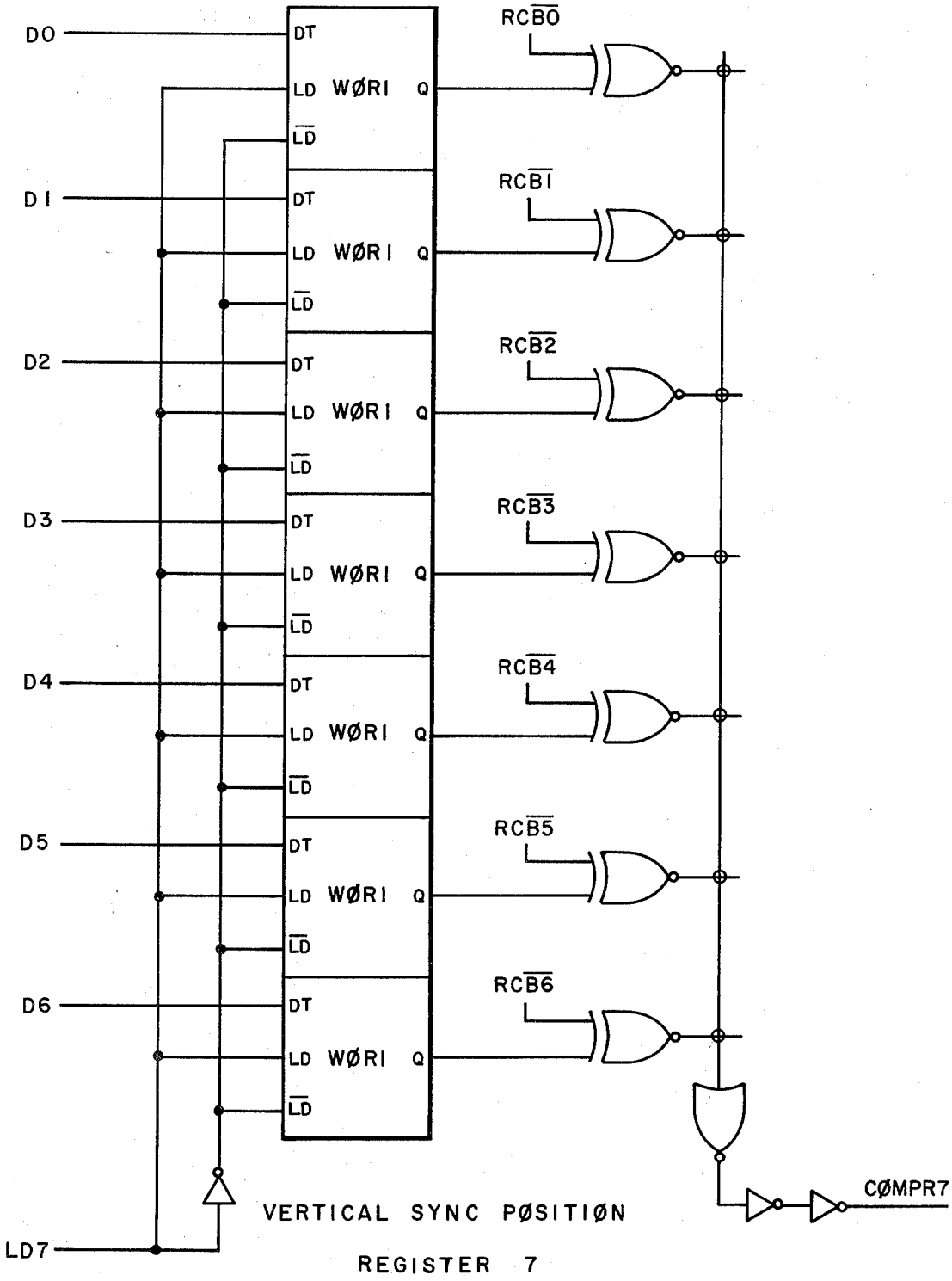

The outputs $RC\overline{B0}$–$RC\overline{B6}$ are also used as an input for the EXCLUSIVE NOR gate array which forms part of the VERTICAL SYNC POSITION REGISTER 7 shown in FIG. 27. The write-only-registers which are used to form register 7 receive inputs over lines D0–D6 of the internal data bus as shown and these registers are used to select the character row time at which the VSYNC pulse is desired to occur and, thus, is used to position the displayed text in the vertical direction. In essence, therefore, the microprocessor using the internal data bus D0–D6 provides an input to the register which pre-programs the number of rows on the CRT screen. When the row counter reaches a count representing this number of rows, the output CϕMPR7 is generated which is used then for generating the vertical VSYNC signal to return the electron beam to the top left of the screen just as the HSYNC signal returns the electron beam to the left side of the screen.

Figure 28:
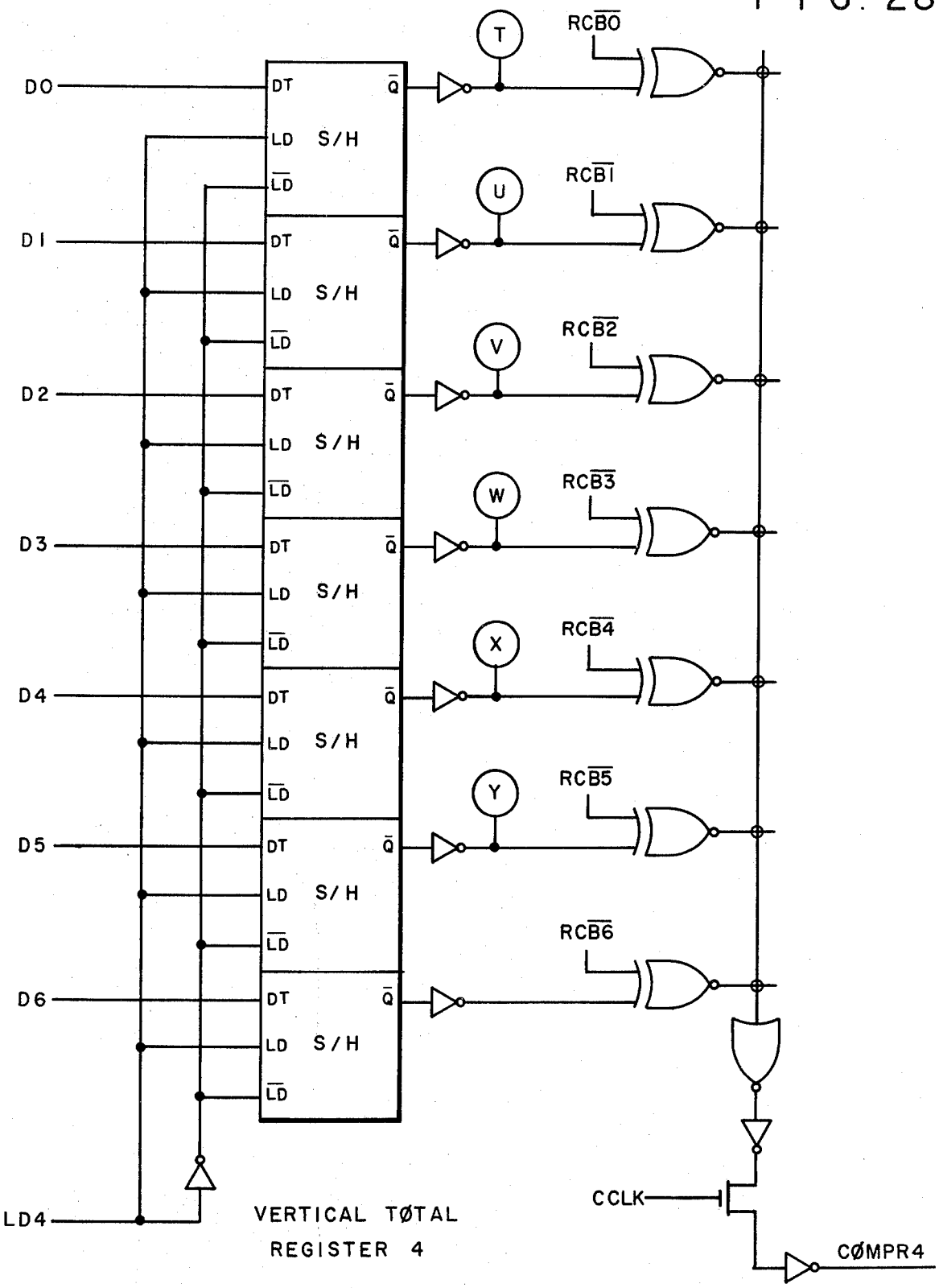

The row counter outputs $RC\overline{B0}$–$RC\overline{B6}$ are also inputted to an EXCLUSIVE NOR gate array shown in FIG. 28 which forms part of the VERTICAL TOTAL REGISTER 4. This register is also comprised of a plurality of sample and hold circuits which receive inputs over lines D0–D6 of the internal data bus. The VERTICAL TOTAL REGISTER 4 is a 7-bit register containing the total number of character rows in a frame, minus one. This register, along with register 5, determines the overall frame rate, which should be close to the line frequency to ensure flicker-free appearance. In essence, therefore, register 4 determines the maximum number of character rows from top to bottom that can be displayed on the CRT screen, and register 6 determines the number of rows that will actually be displayed.

When the row counter output reaches the sample and hold register 4 output, CϕMPR4 is generated which provides an input to the logic associated with the refresh address generator described above. This register also provides outputs T–Y which provides input to the EXCLUSIVE NOR gate array associated with register 18 to provide an input of the logic which clears the counter forming a part of register 18.

Figure 29:
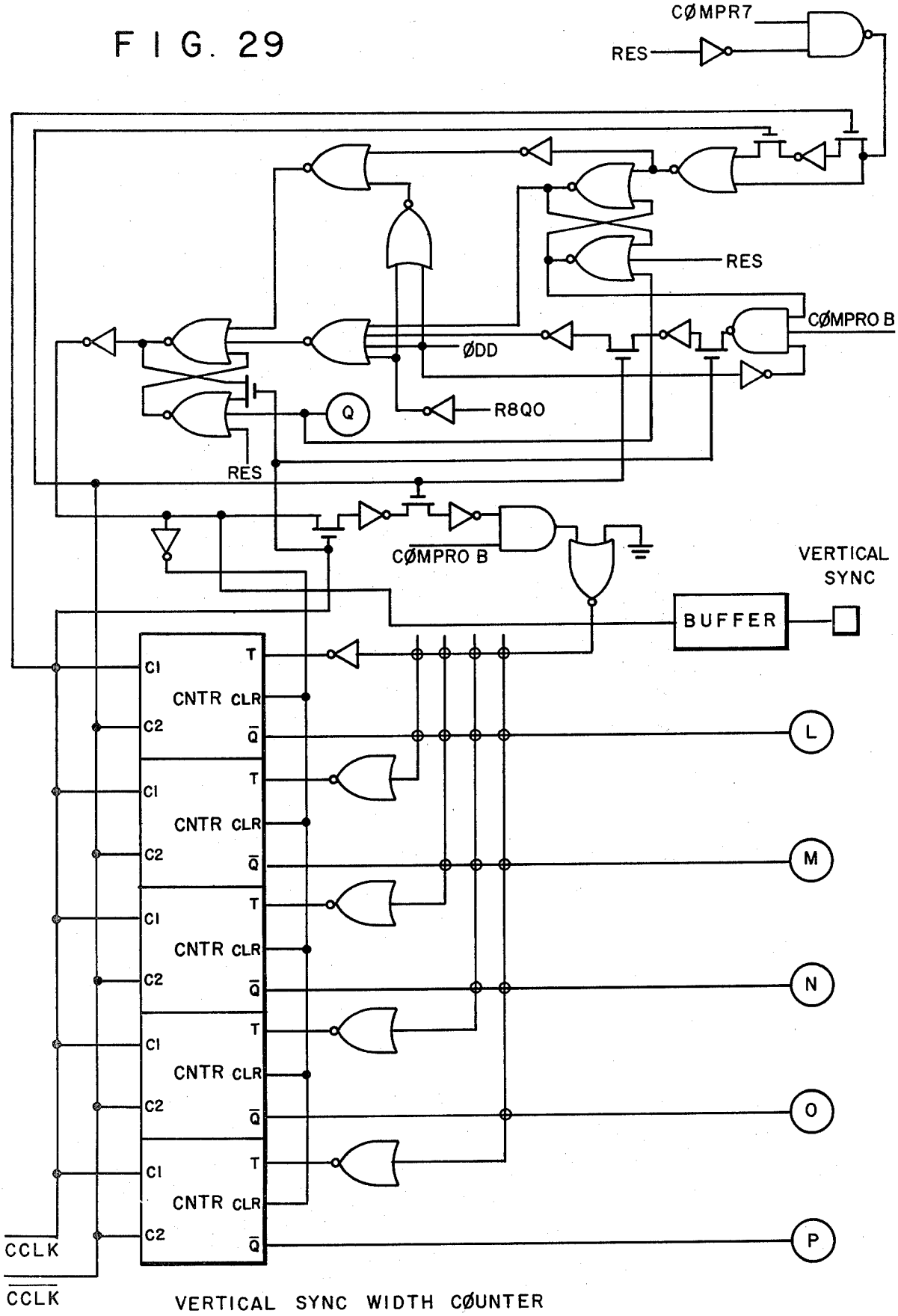
Figure 30:
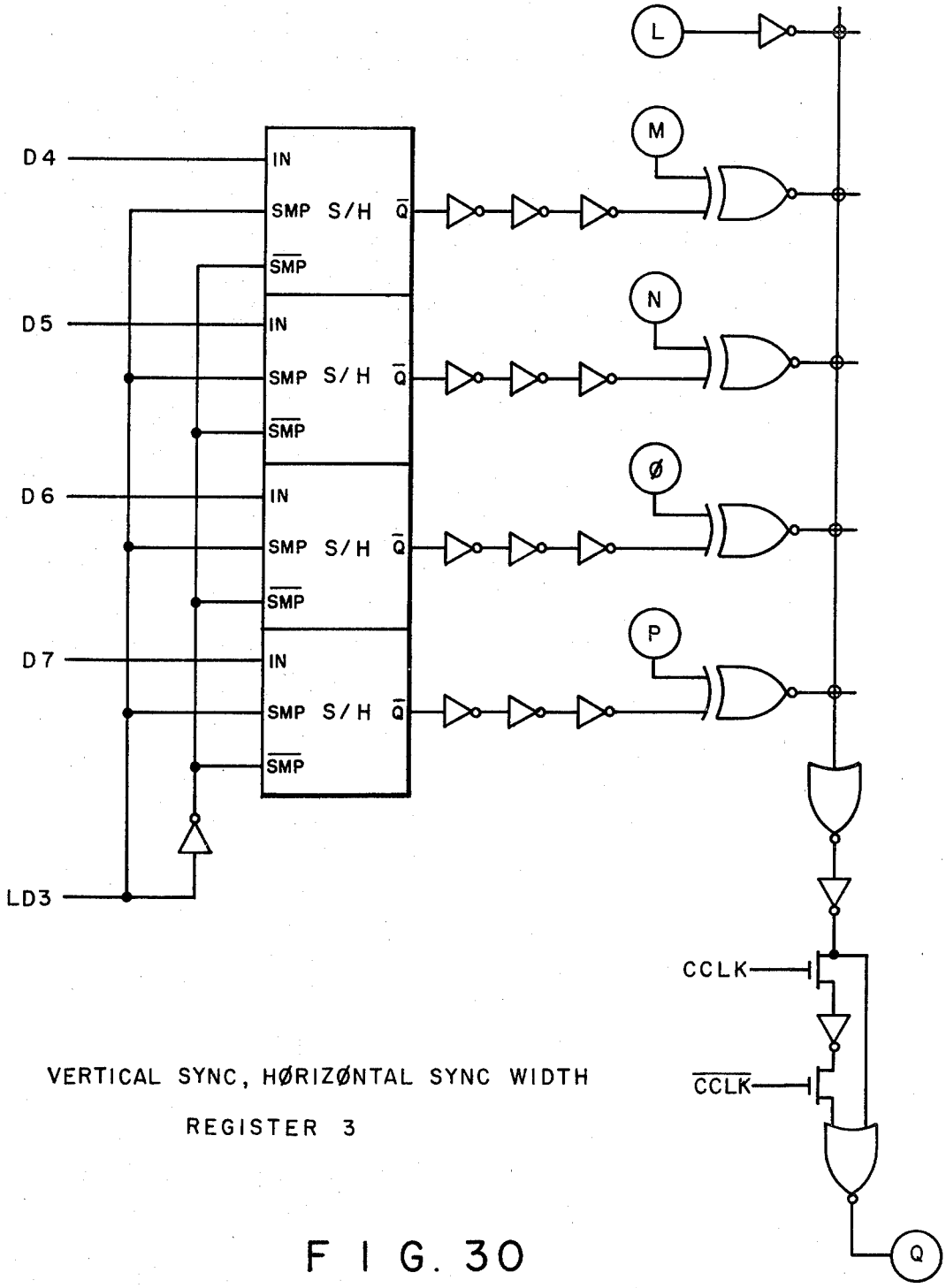
Figure 31:
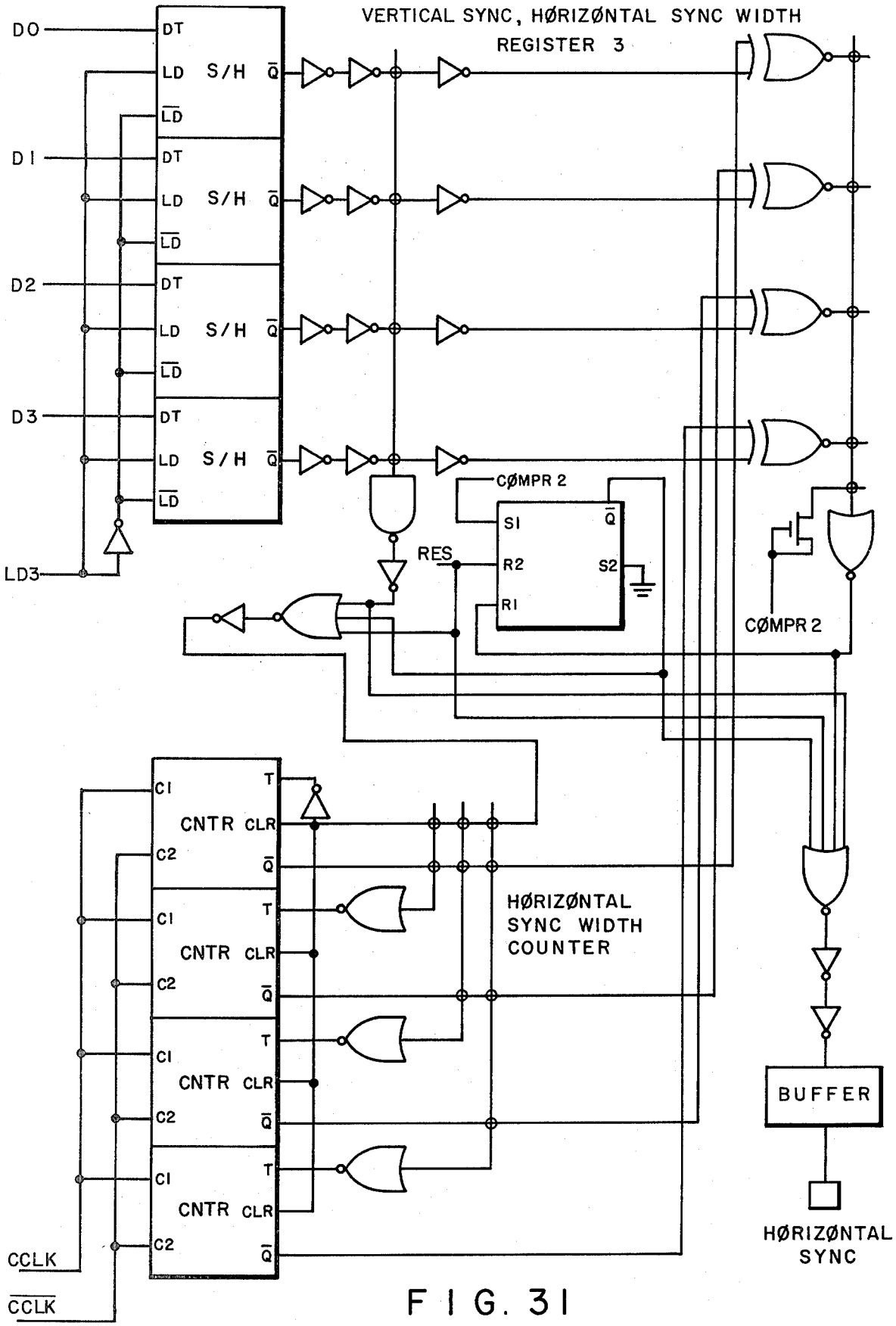

FIG. 29 shows the VERTICAL SYNC WIDTH COUNTER which utilizes the character clock signal for providing an output count on outputs L–P. FIG. 29 also shows the logic which generates the vertical sync signal VERT SYNC and the logic which clears and toggles the VERTICAL SYNC WIDTH COUNTER. The outputs from this counter are connected to a plurality of EXCLUSIVE NOR gates forming a part of register 3 shown in FIG. 30. This register also contains a plurality of sample and hold blocks which receive inputs from data lines D4–D7 of the internal data bus. FIG. 31 shows the other part of register 3 together with the HORIZONTAL SYNC WIDTH COUNTER which counts character clock signals and provides an output to the EXCLUSIVE NOR gate array which forms a part of register 3. This portion of register 3 contains a plurality of sample and hold blocks which receive inputs from data lines D0–D3 of the internal data bus. Register 3 as a whole is an 8-bit register which contains the widths of both signals HSYNC and VSYNC. Control of these parameters allows the controller 10 to be interfaced to a variety of CRT monitors since the HSYNC and VSYNC timing signals may be accommodated without the use of external timing circuits. The sample and hold registers which form the register 3 are inputted from the internal data bus D0–D7.

Figure 32:
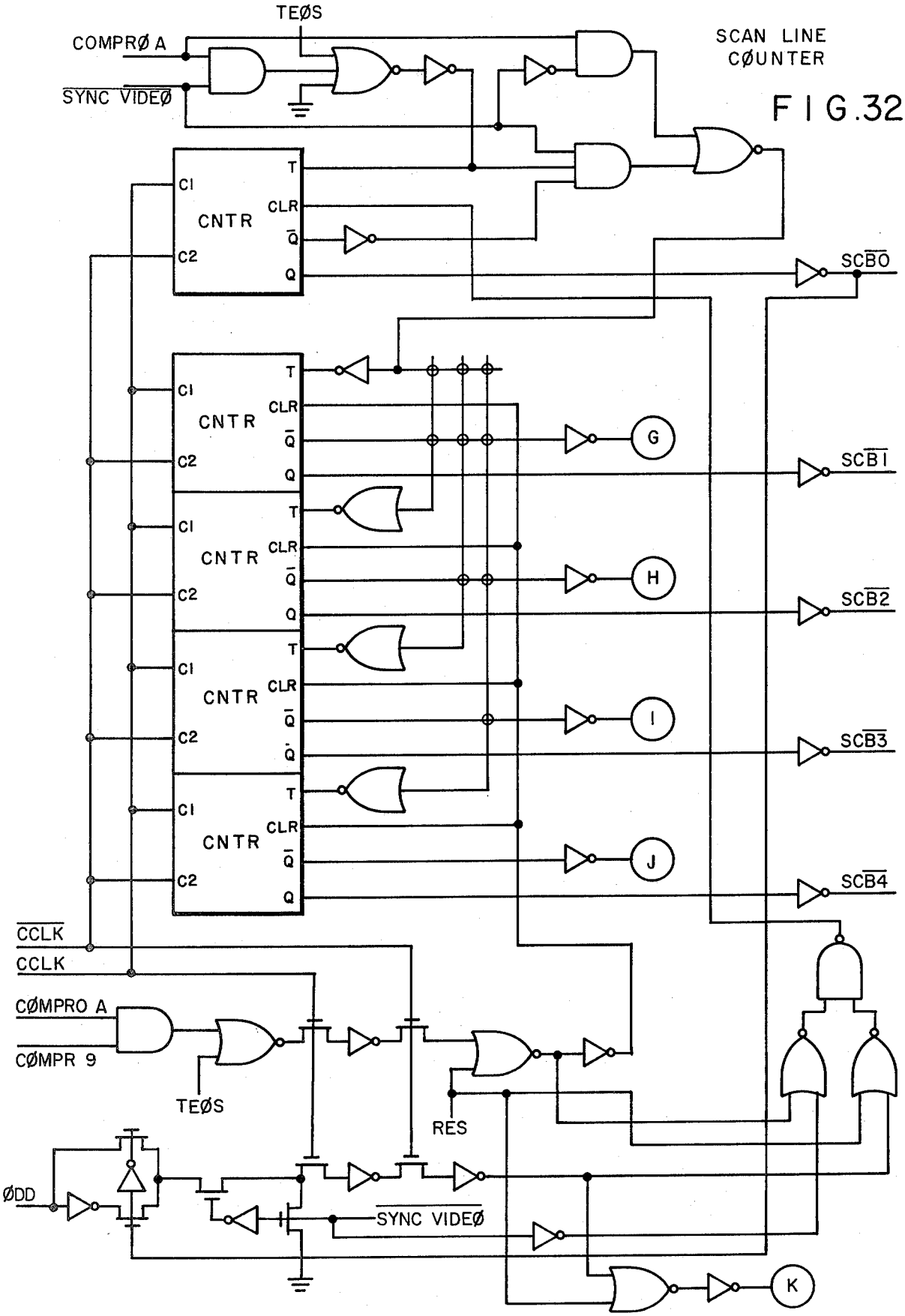
Figure 33:
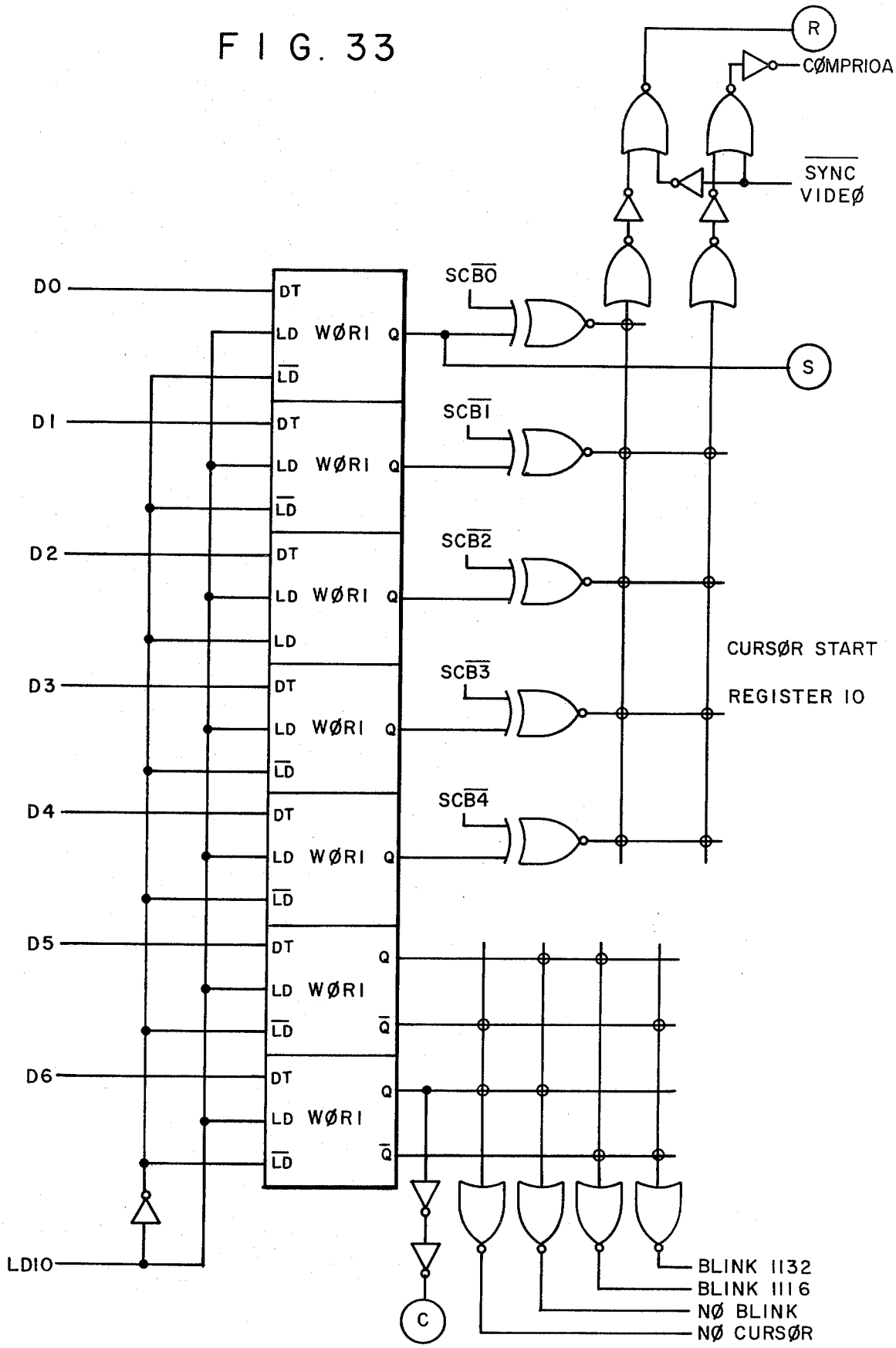

FIG. 32 shows the SCAN LINE COUNTER which divides the grids established by the row and column counters into smaller rectangles. Thus, the scan line counter divides the grids into smaller rows. This counter counts the character clock and provides outputs $SC\overline{B0}$–$SC\overline{B4}$ and further outputs G–J. Outputs $SC\overline{B0}$–$SC\overline{B4}$ are provided as inputs in FIG. 33 to the EXCLUSIVE NOR gates shown therein which form part of the CURSOR START REGISTER 10. Write-only-registers also form a part of register 10 and these blocks receive inputs from data lines D0–D6 of the internal data bus. The top five write-only-registers form a 5-bit register for selecting the starting scan line for the cursor. As to be discussed hereinafter, register 11 determines the ending scan line for the cursor. The ability to program both the start and end scan line for the cursor enables either block cursor or underline to be accommodated. If the outputs CϕMPR10A and R are followed through the circuit, it will be seen that these outputs are used to generate the CURSOR output from controller 10. Furthermore, the lower two blocks shown in FIG. 33 are used to determine the cursor mode. Thus, the cursor may be blinked or not blinked, and if it is blinked it may be blinked at 1/16 field rate or 1/32 field rate.

Figure 34:
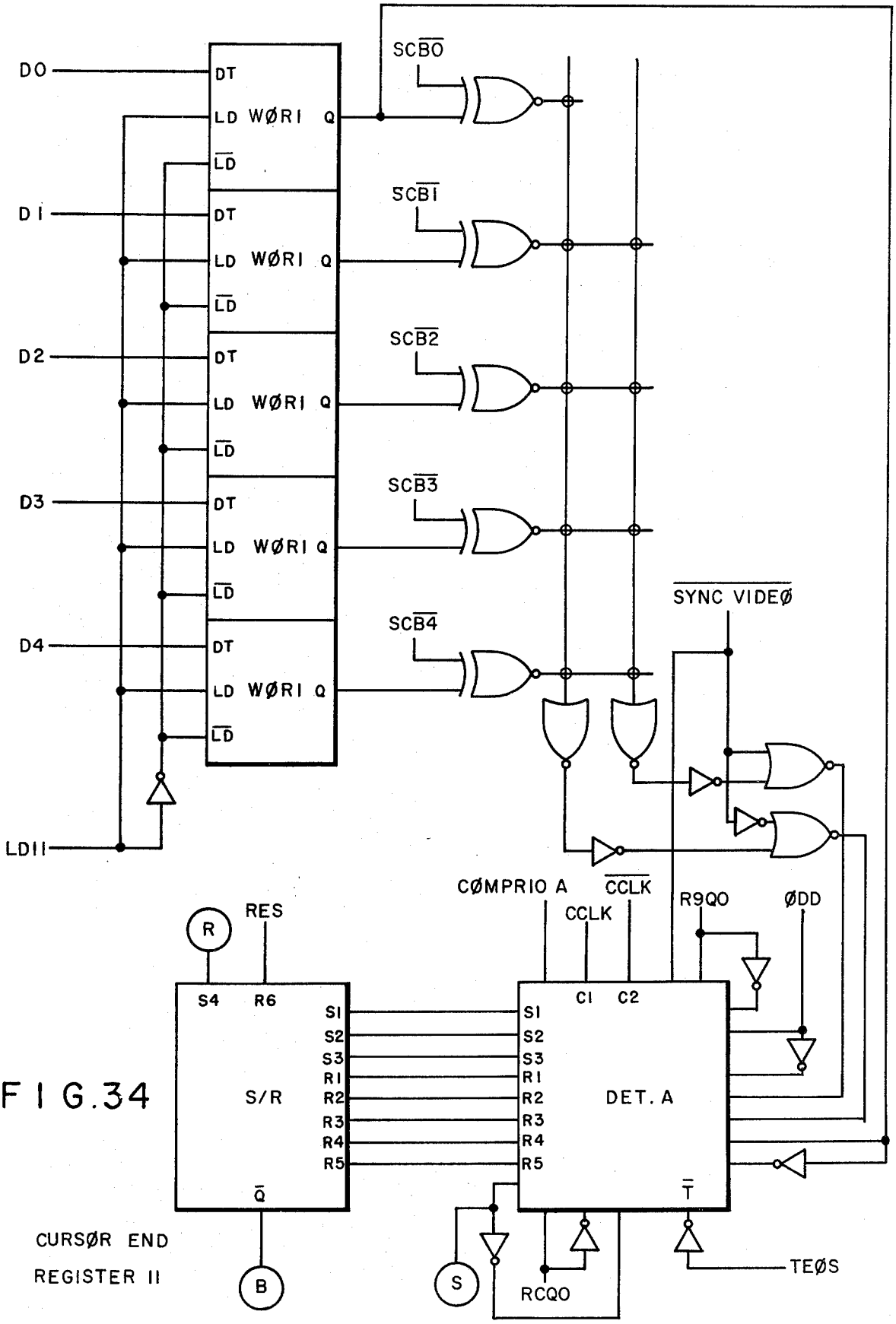

FIG. 34 shows the register 11 mentioned above. The outputs from this register together with the outputs from register 10 are used by the S/R and the DET. A circuits for generating an output at terminal B which is used then for providing the cursor output from controller 10.

In addition, outputs G–J of the scan line counter shown in FIG. 32 are connected to an EXCLUSIVE NOR gate array shown in FIG. 13. This EXCLUSIVE NOR gate array together with the write-only-registers and the blocks 61 form SCAN LINE REGISTER 9. SCAN LINE REGISTER 9 is a 5-bit register which contains the number of scan lines per character row, including spacing. In essence, register 9 determines the number of scan lines per character line. Thus, the write-only-registers are connected to data lines D0–D4 of the internal data bus and provide an appropriate output on the terminal shown therein which are then compared by the EXCLUSIVE NOR gate with the SCAN LINE COUNTER to provide the CϕMPR9 output which is used for controlling the refresh address generator and is used as inputs to the various counters and registers for toggling and control purposes.

Figure 35:
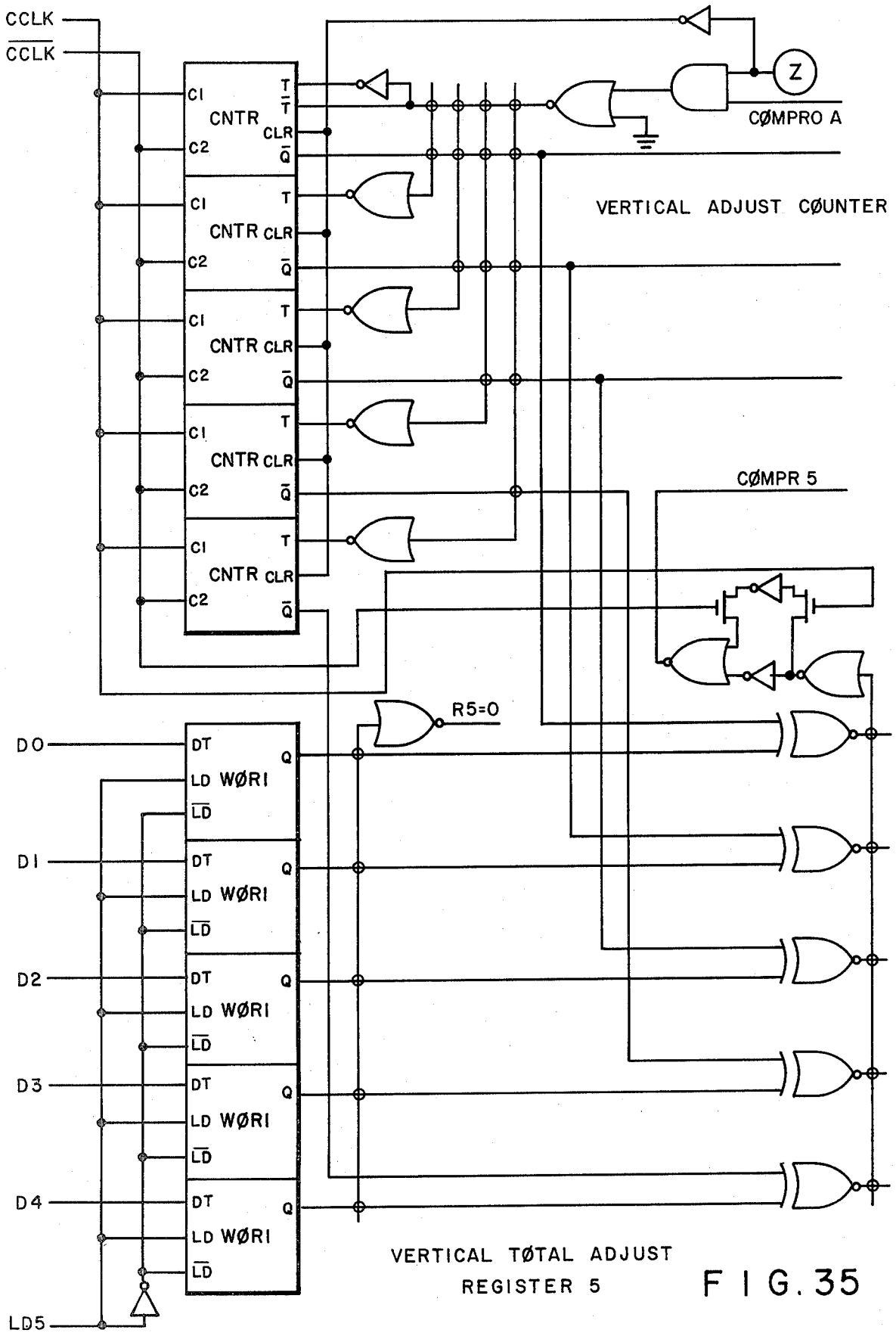

The VERTICAL ADJUST COUNTER shown in FIG. 35 counts character clock signals for providing the output to the EXCLUSIVE NOR gate array which forms part of the VERTICAL TOTAL ADJUST REGISTER 5 also shown in FIG. 35. The write-only-registers which form a part of register 5 receive inputs from data lines D0–D4 of the internal data bus. Register 5 is a 5-bit write-only-register containing the number of additional scan lines needed to complete an entire frame scan and is intended as a fine adjustment for the video frame time. The microprocessor, by providing appropriate inputs to register 5 over lines D0–D4, pre-programs the vernier control to keep track of timing functions. The output CϕMPR5 from the EXCLUSIVE NOR gate array is connected as an input to control the refresh address generator. The output R5=0 also is used as a control input to the refresh address generator.

Figure 36:
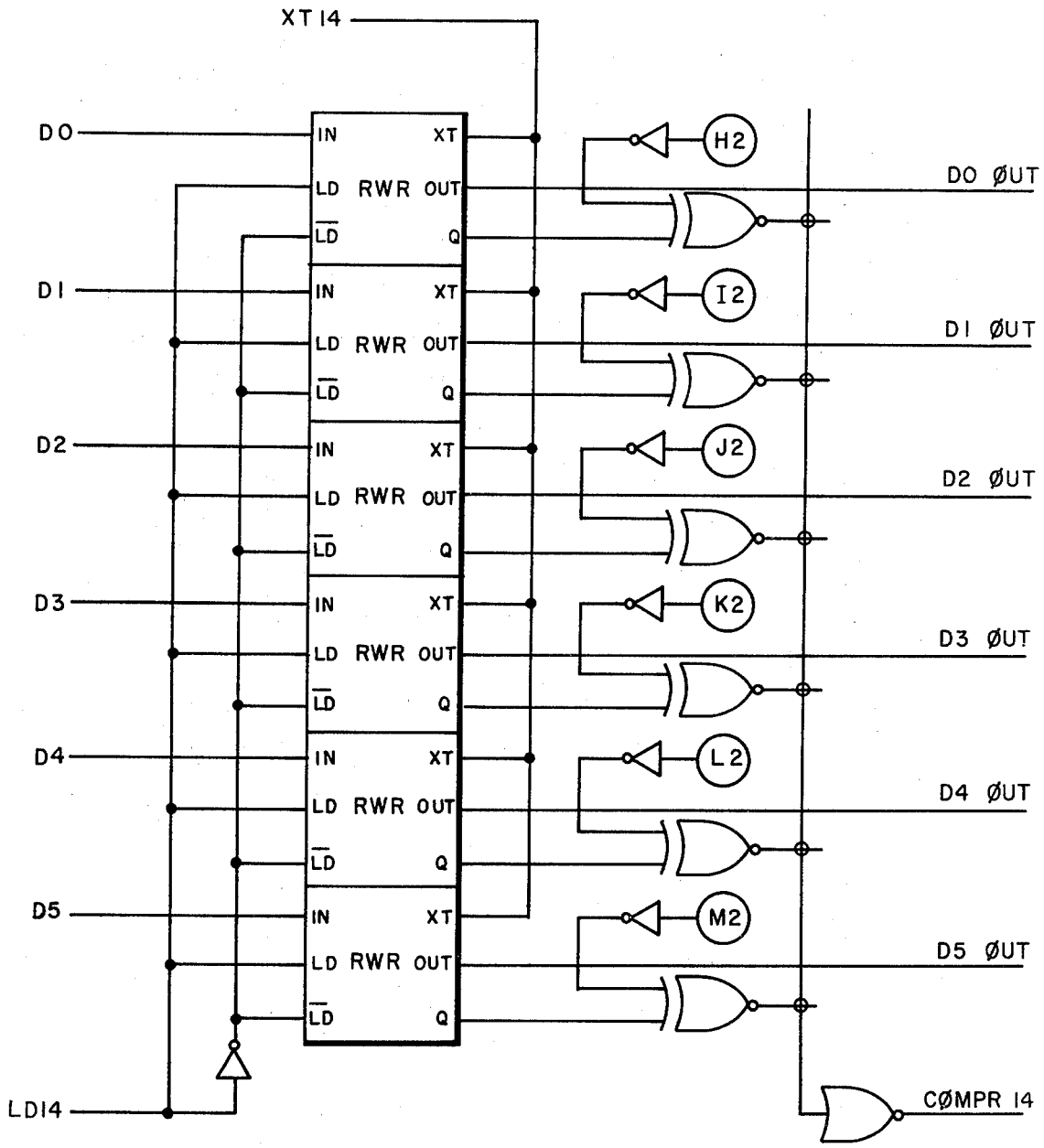
Figure 37:
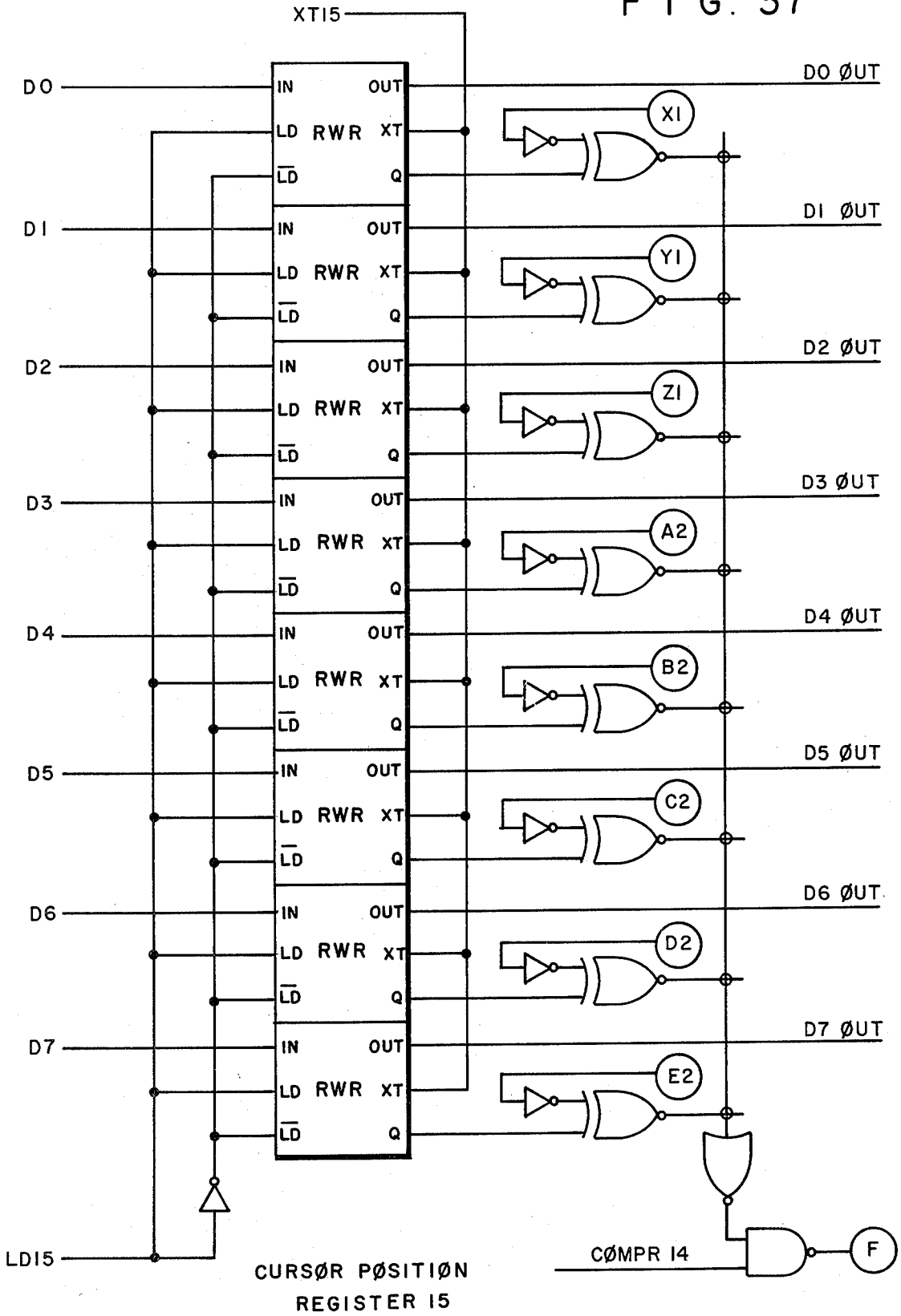

FIGS. 36 and 37 show the CURSOR POSITION REGISTER which comprises a 14-bit register whose contents is the memory address of the current cursor position. When the video display scan counter, i.e., the jam set counter shown in FIGS. 2–4 which generates the address on the memory address internal bus, matches the contents of the CURSOR POSITION REGISTER, and when the scan line counter, shown in FIG. 32, falls within the bounds set by registers 10 and 11, then the cursor output from controller 10 becomes active. Bit 5 of the mode control register 8 may be used to delay the cursor output by a full character clock time to accommodate slow access memories. As shown in FIGS. 36 and 37, the CURSOR POSITION REGISTERS 14 and 15 comprise a plurality of read/write register blocks, each connected to a specific data line of the internal data bus and providing an output to a specific line of the internal data out bus. Thus, the EXCLUSIVE NOR gates which receive an input from the individual read/write register blocks also receive inputs from the jam set counter which form part of memory address registers 18 and 19. The output from these EXCLUSIVE NOR gate arrays is taken at terminal F which is used to control the cursor output from controller 10.

Figure 38:
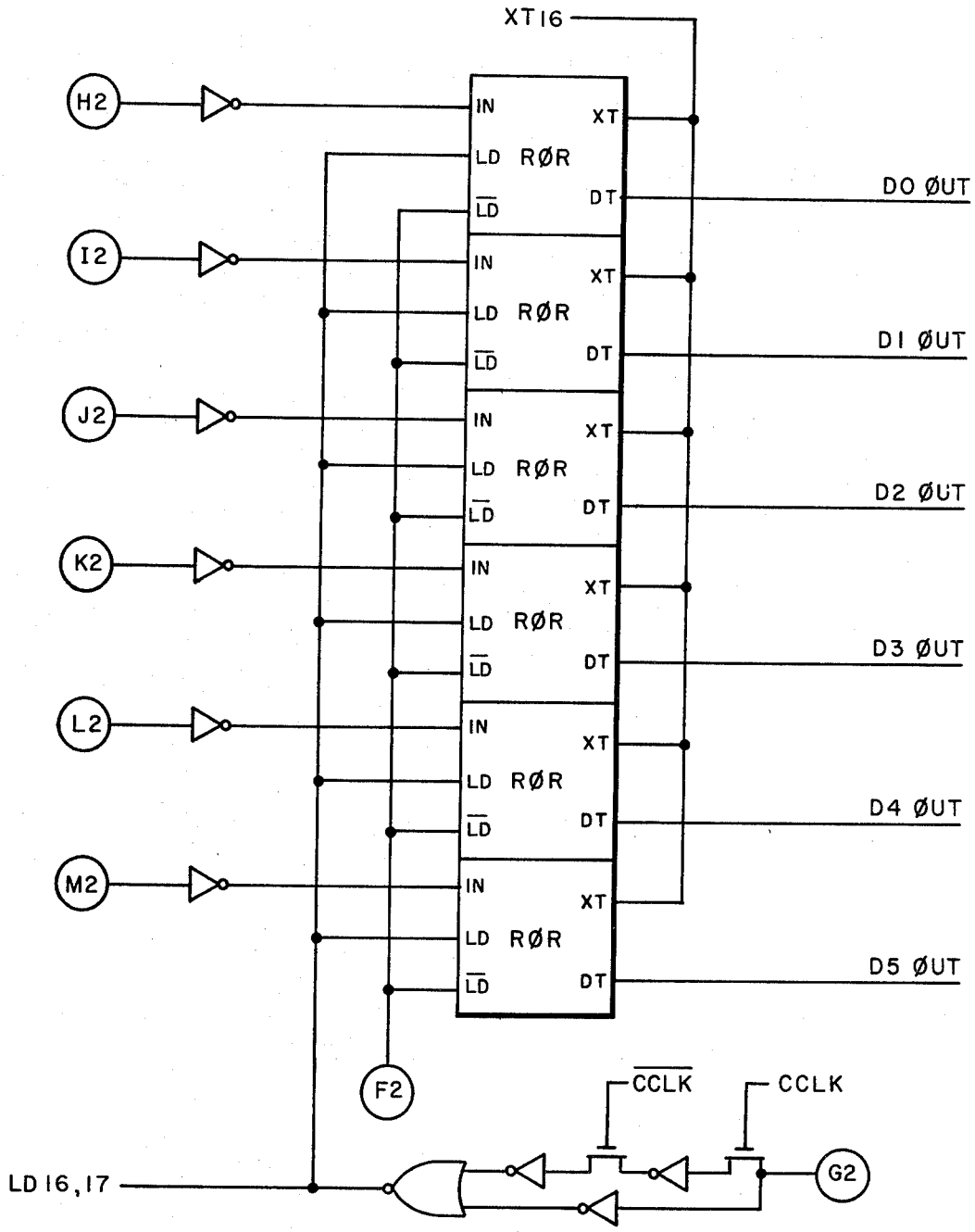
Figure 39:
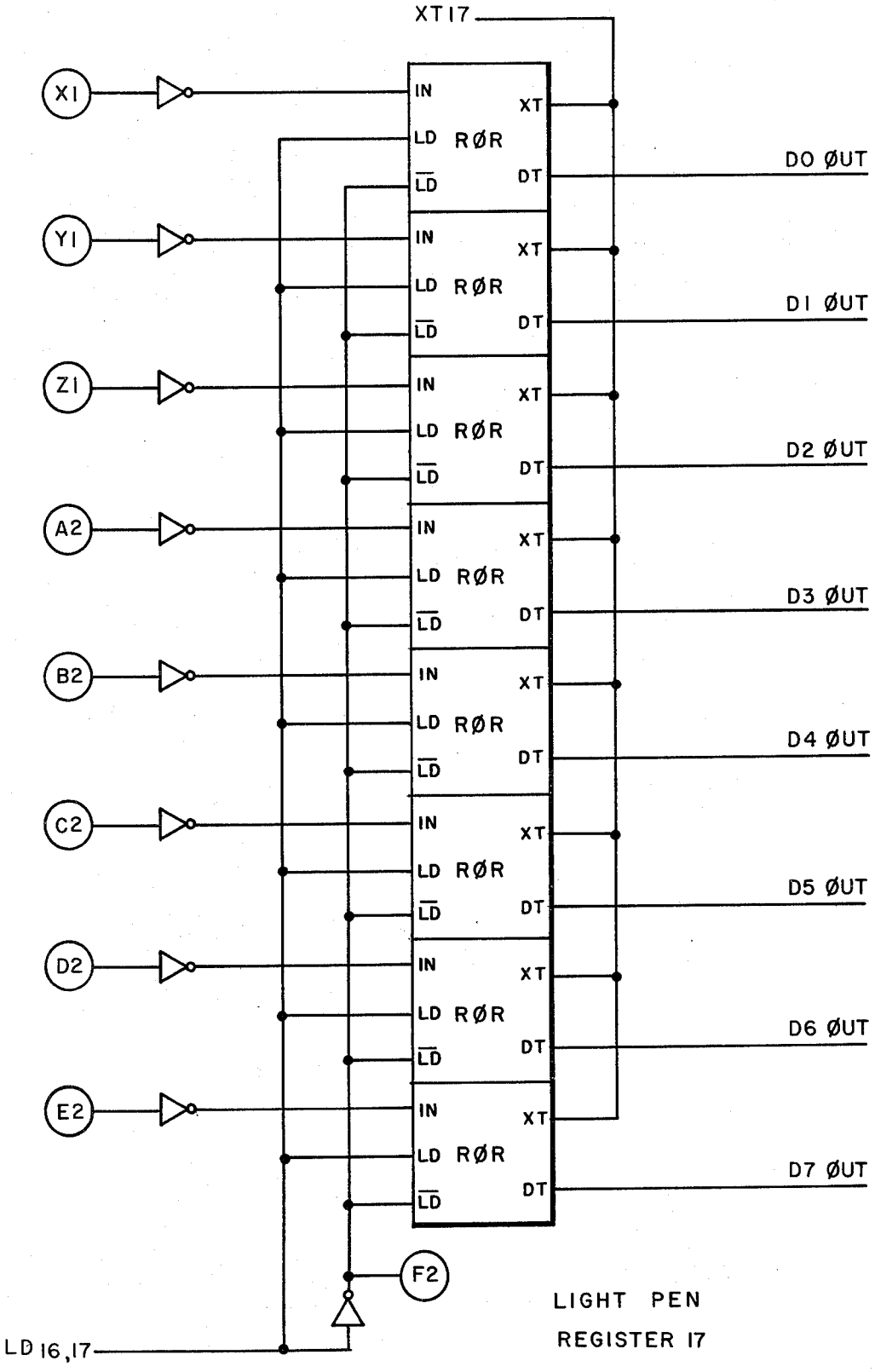

FIGS. 38 and 39 show the LIGHT PEN REGISTERS 16 and 17 which are comprised of a plurality of read-only-register blocks, each having an input connected to a specific output from the memory address generator. The information from the memory address generator is loaded into registers 16 and 17 by use of the LD 16, 17 input. The output from these registers is supplied over the internal data out bus. These registers together comprise a 14-bit register whose contents is the light pen strobe position in terms of the video display address at which the strobe occurred. When the L-pen input changes from low to high, then, on the next negative going edge of the character clock, the contents of the internal scan encounter are stored in registers 16 and 17. In other words, these registers capture a 14-bit word from the jam set counter, as determined by the light pen. These registers store an address depending on where the light pen is positioned on the CRT screen.

Figure 40:
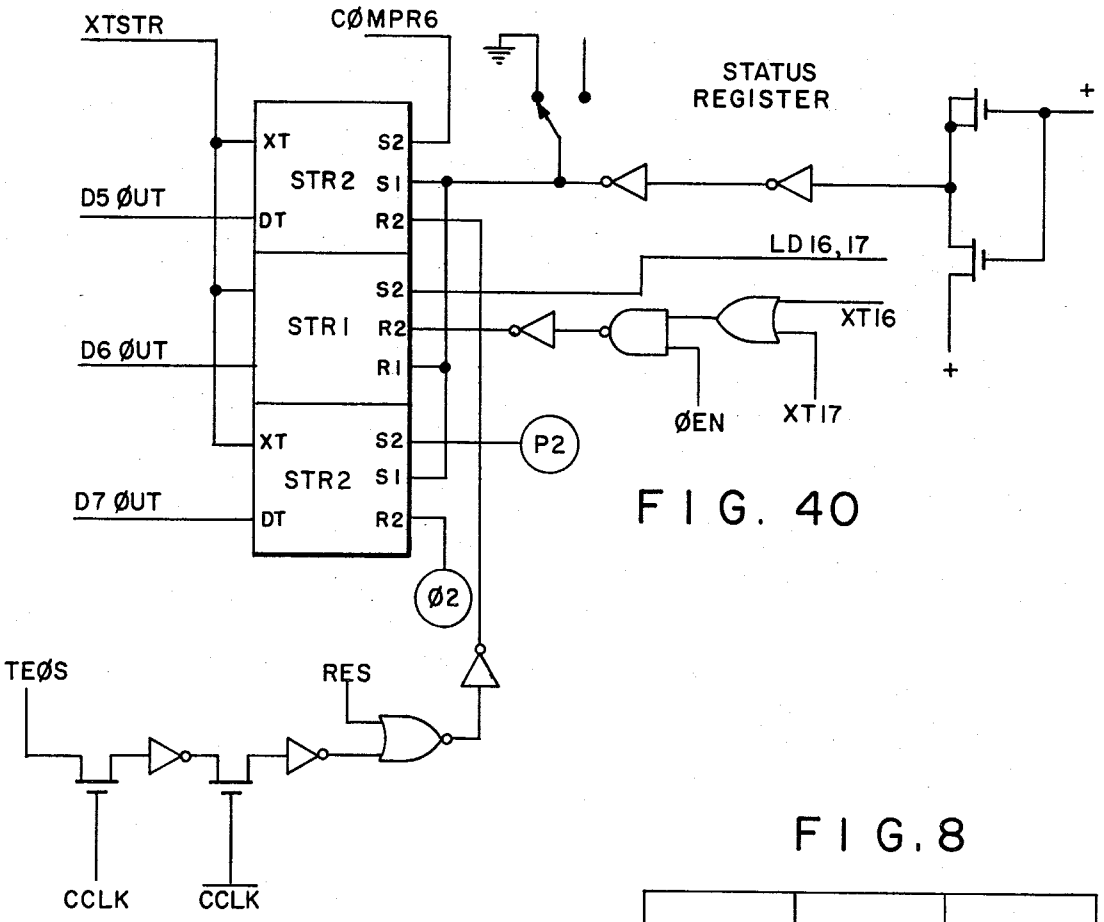

The status register is shown in FIG. 40 (sheet 7) and comprises a 3-bit register which is used to monitor the status of the CRT. Specifically, the output D5 OUT indicates whether vertical blanking is occurring or not. A zero on this line indicates that the scan is not currently in the vertical blanking portion of its timing whereas a one indicates that vertical blanking is occurring. The output on D6 OUT indicates whether or not the LIGHT PEN REGISTERS 16 and 17 are full. This bit goes to zero whenever either register 16 or 17 is read by the microprocessing unit connected to controller 10 and goes to one whenever a LPEN strobe occurs. Finally, the output on D7 OUT indicates whether an update operation is ready. This bit goes low when a read or write RAM operation is selected. Once the RAM address has been outputted for three character clock times, this bit returns high.

Figure 41:
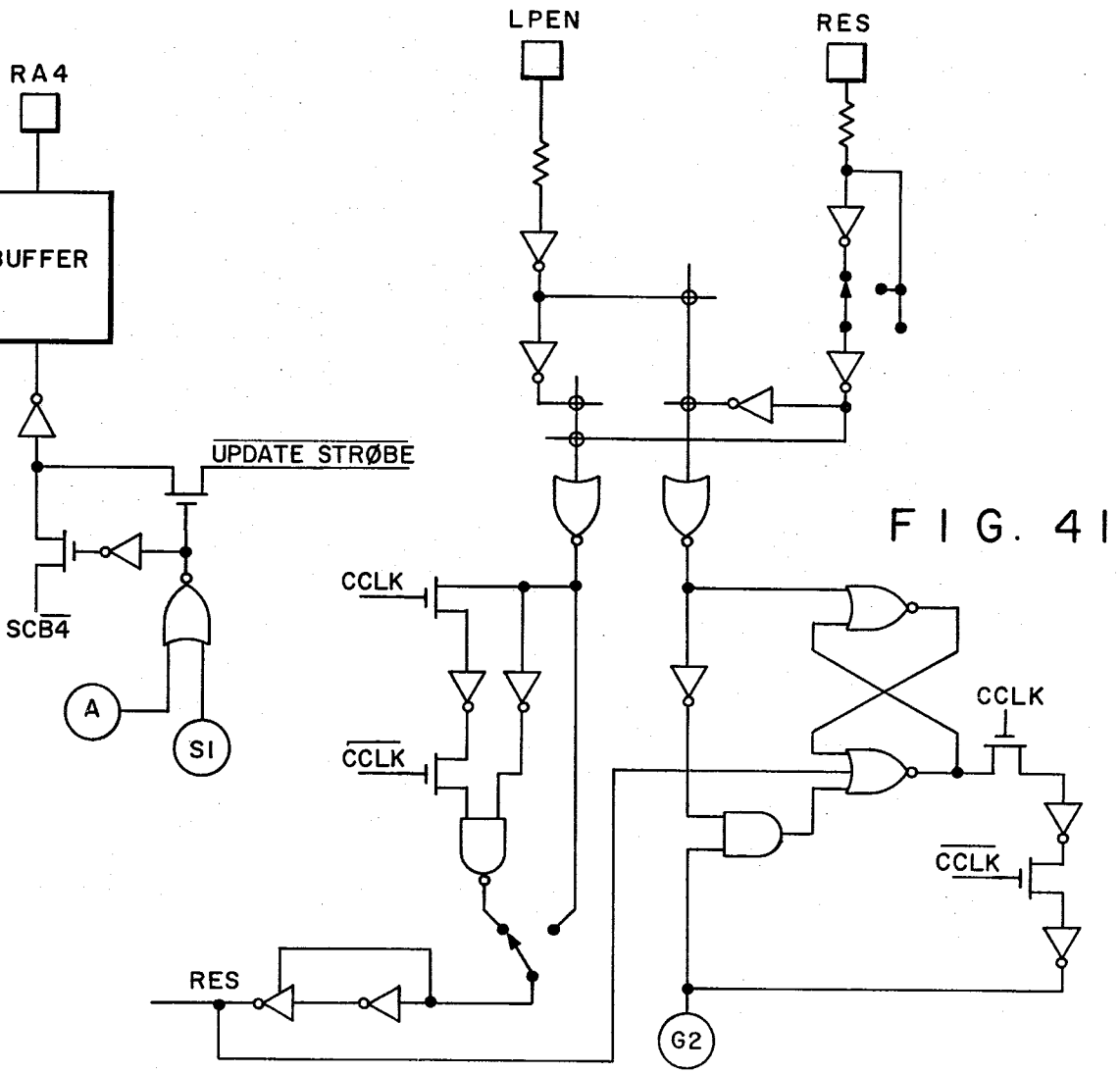

FIG. 41 (sheet 11) shows how the LD 16, 17 signal is generated by the use of the LPEN input to terminal G2. This figure also shows how the internal reset signal is generated from the reset input to controller 10.

Figure 16:
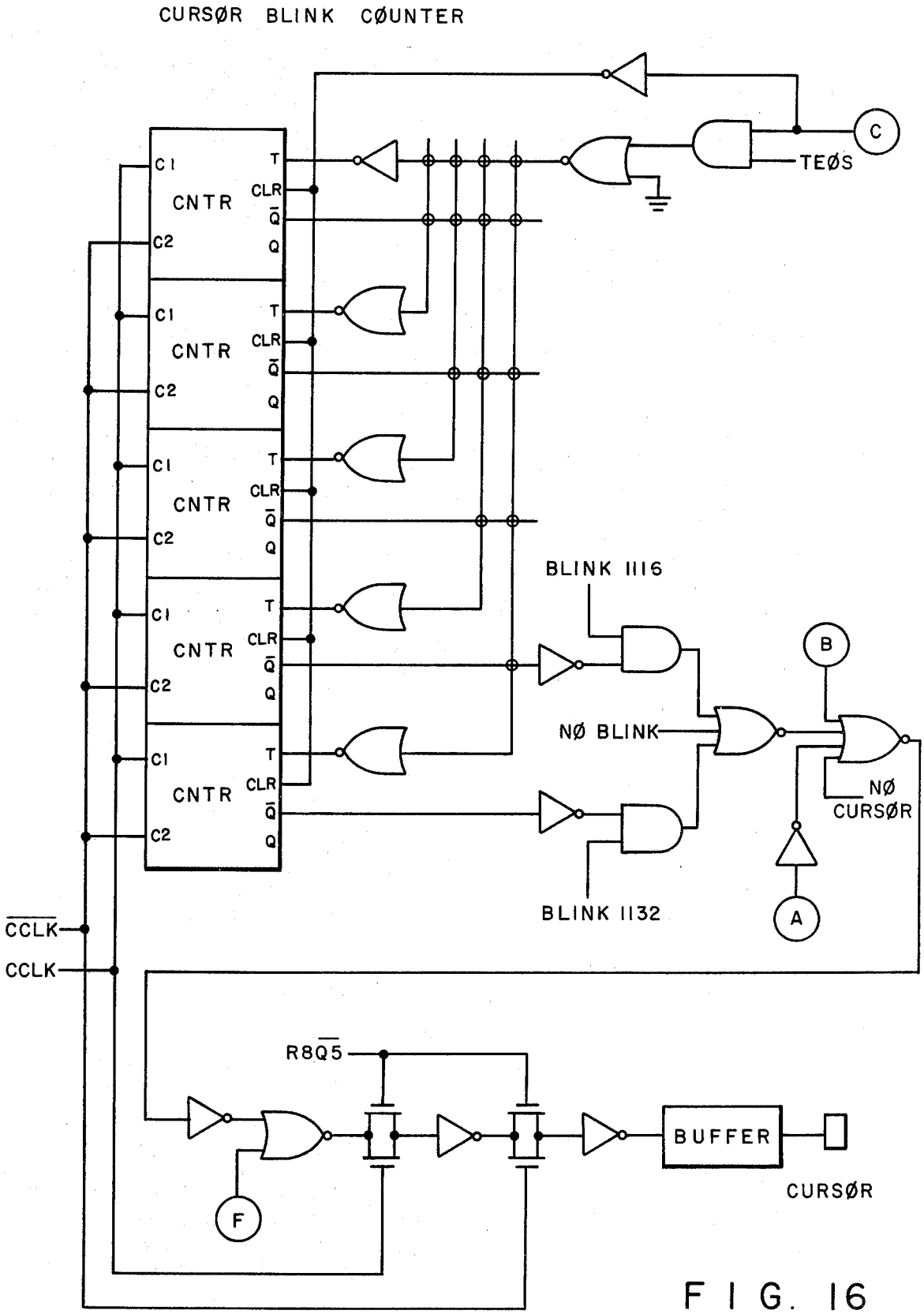

FIG. 16 shows the cursor blink counter which controls the blink rate for flashing graphics. This counter is comprised of a plurality of counter blocks which are stepped by the character clock and are used to form the cursor output. This counter receives an input from register 10 at terminal C to determine whether or not blinking should occur.

Figure 42:
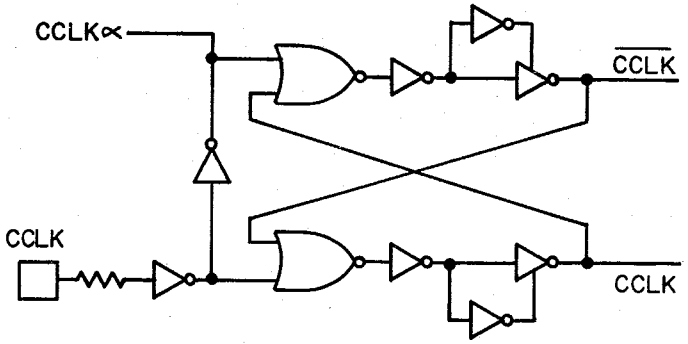
Figure 45:
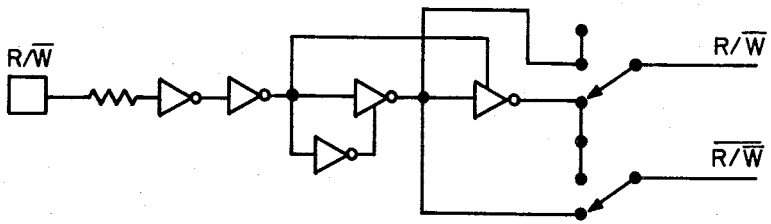
Figure 43:
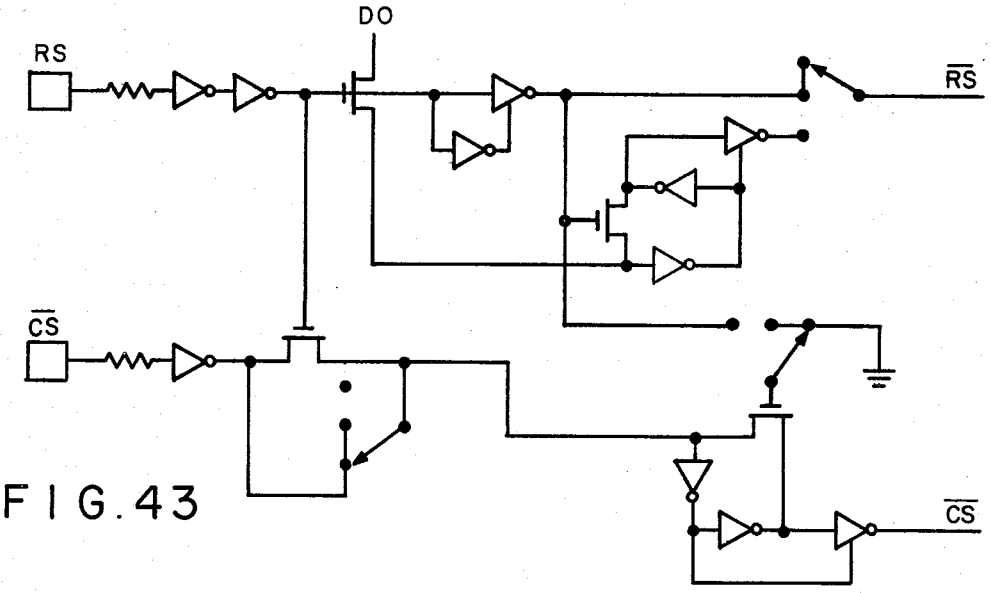
Figure 44:
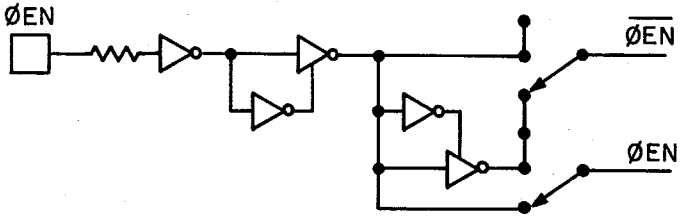
Figure 47:
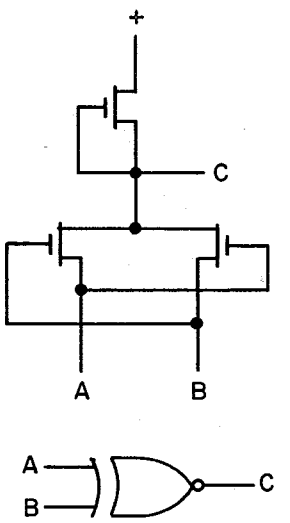
FIG. 47 shows in more detail the Exclusive NOR gate which is used in Controller 10.
Figure 46:
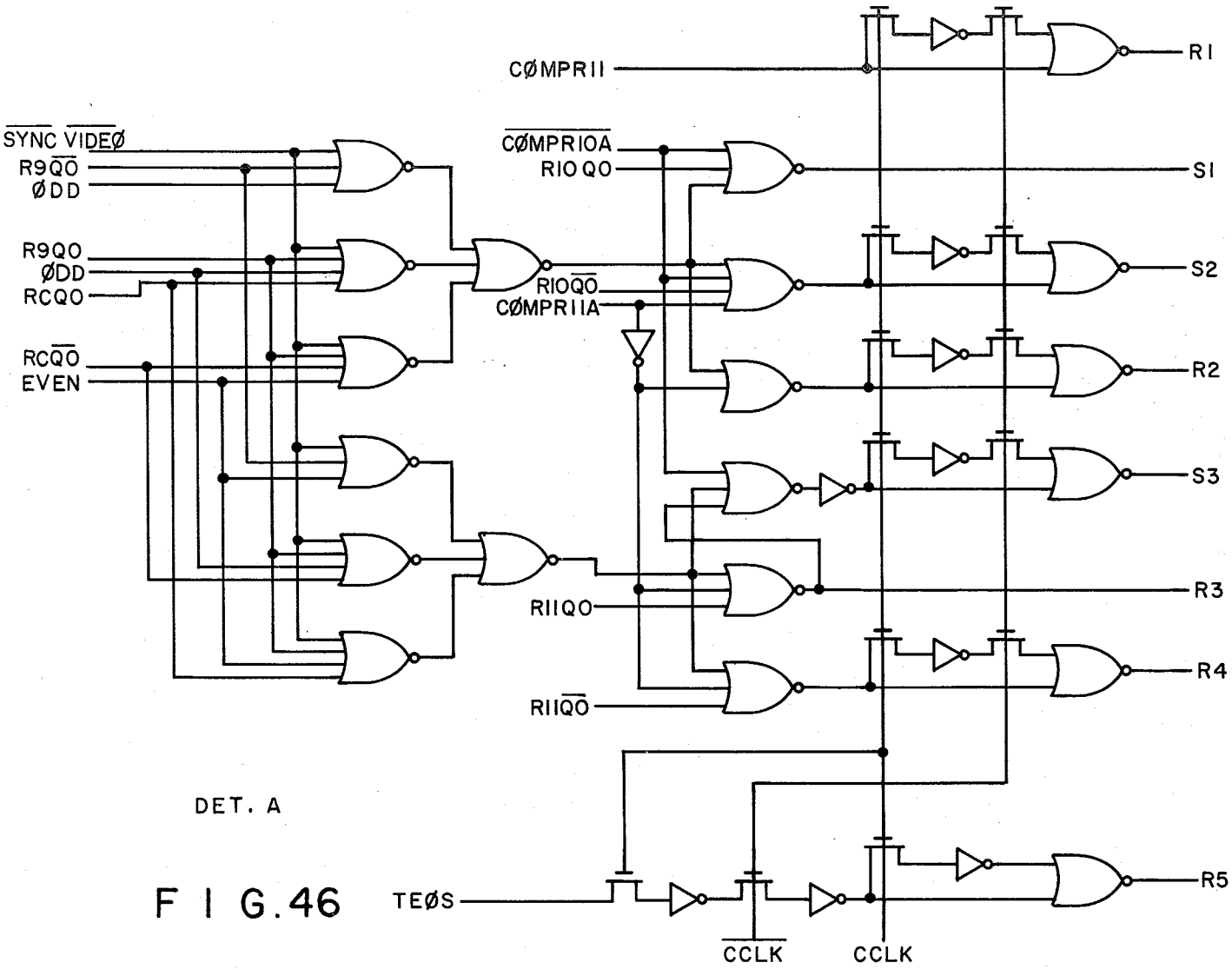
FIG. 46 shows the DET. A block of FIG. 34.

FIG. 42 shows how the character clock signals are generated from the character clock input to controller 10. FIG. 43 shows how the register select $\overline{RS}$ and the chip select $\overline{CS}$ signals are generated from the $\overline{RS}$ and $\overline{CS}$ inputs to controller 10. FIG. 44 shows how the ϕEN and $\overline{\phi EN}$ clock signals are generated from ϕEN input to controller 10 and FIG. 45 shows how the R/$\overline{W}$ and $\overline{R/W}$ signals are generated from read/write R/W input to controller 10. FIG. 46 shows the DET A block of FIG. 34. FIG. 47 shows how the EXCLUSIVE NOR gate used throughout the circuits shown herein may be configured.

FIGS. 48–58 show how the various blocks which make up the registers and counters shown in FIGS. 2–41 may be configured. Thus, the jam set counter shown in FIG. 57 may be used for the jam set counter blocks shown in FIGS. 2–4. The sample and hold circuit shown in FIG. 56 may be used for the sample and hold circuits shown in FIGS. 2–4. The status registers 1 and 2 are shown in more detail in FIGS. 54 and 49.

Figure 50:
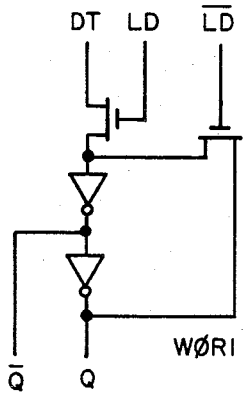
FIG. 50 shows the Write-Only-Register.
Figure 49:
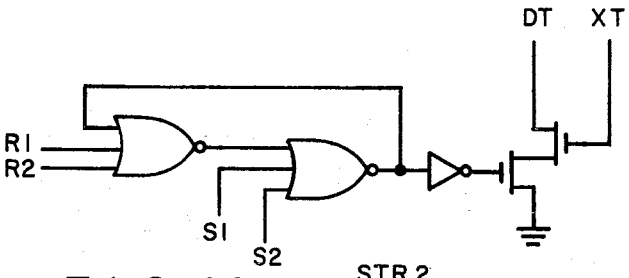
FIG. 49 shows the Status Register 2.
Figure 48:
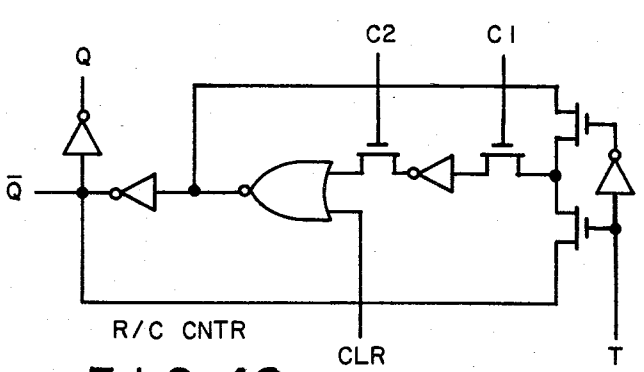
FIG. 48 shows the Row/Column Counter.
Figure 53:
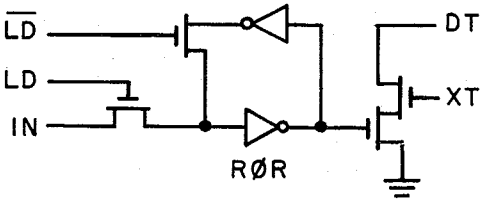
FIG. 53 shows the Read-Only-Register.
Figure 52:
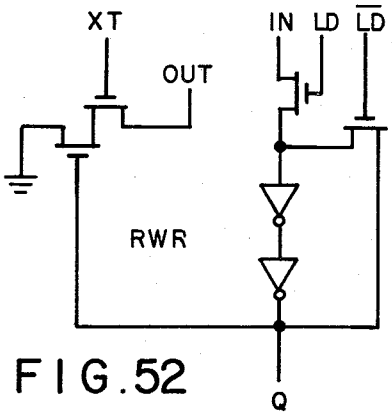
Figure 51:
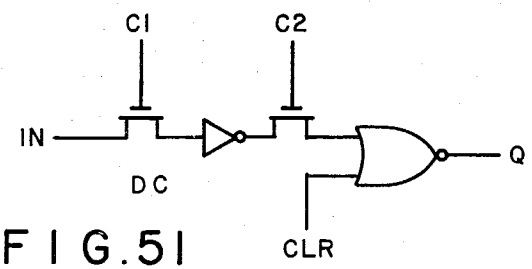
FIG. 51 shows the DC circuit, FIG. 52 show the Read/Write Register.
Figure 56:
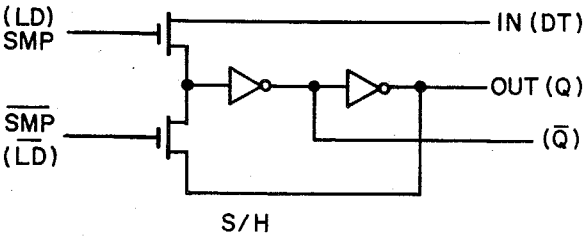
FIG. 56 shows the Sample/Hold circuit.
Figure 55:
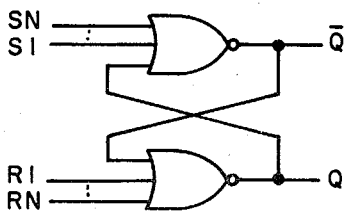
FIG. 55 shows the Set/Reset Flip-Flop.
Figure 54:
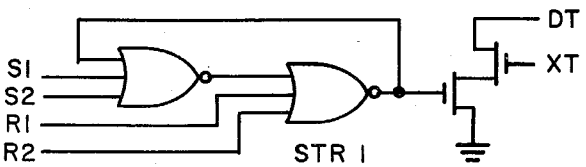
FIG. 54 shows the Status Register 1.
Figure 58:
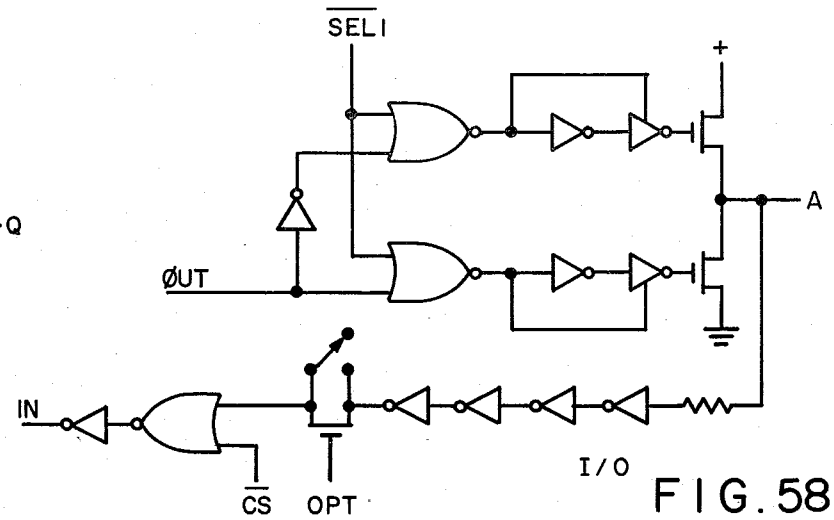
FIG. 58 shows the Input/Output circuit.
Figure 60:
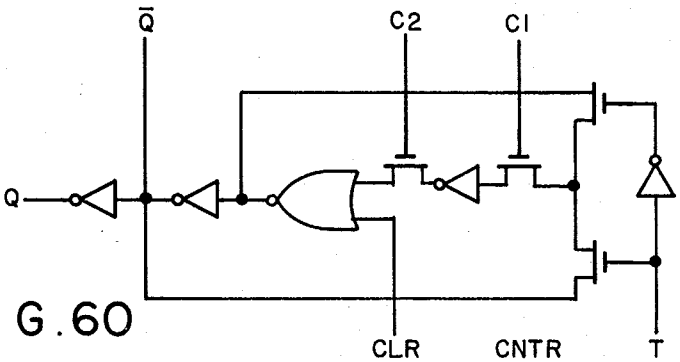
FIG. 60 shows the counter CNTR.
Figure 62:
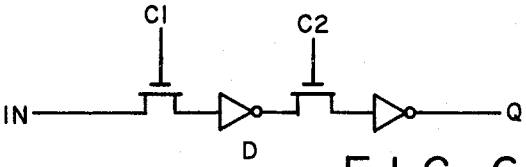
FIG. 62 shows the D circuit.
Figure 57:
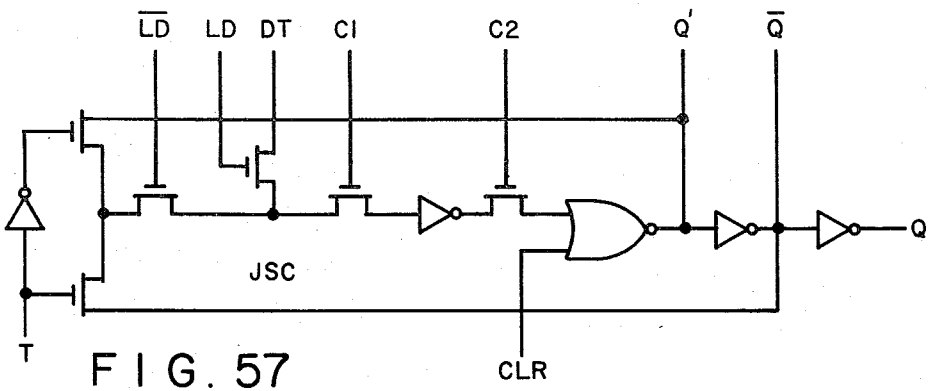
FIG. 57 shows the Jam Set Counter.
Figure 59:
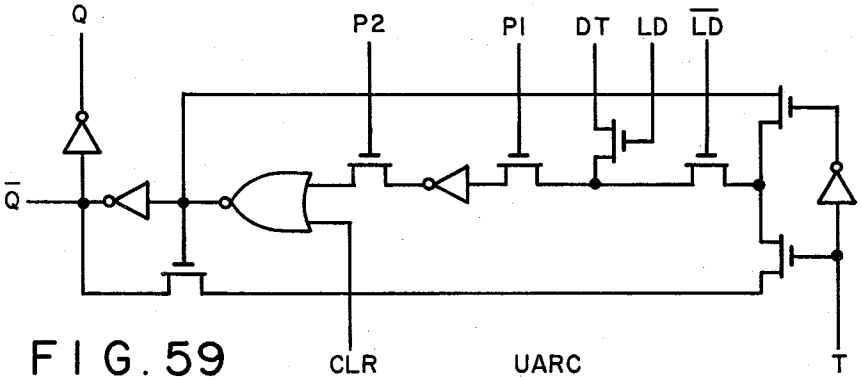
FIG. 59 shows the UARC Counter.
Figure 61:
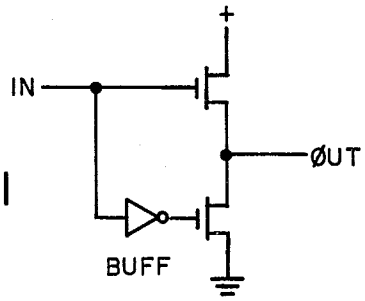
FIG. 61 shows a buffer.

FIG. 48 shows the row/column counter R/C CNTR, FIG. 49 shows the status register STR2, FIG. 50 shows the write-only-register WϕR1, FIG. 51 shows the DC circuit, FIG. 52 shows the read/write register RWR, FIG. 53 shows the read only register RϕR, FIG. 54 shows the status register STR1, FIG. 55 shows the set/reset flip-flop SR, FIG. 56 shows the sample/hold circuit S/H, FIG. 57 shows the jam set counter JSC, FIG. 58 shows the input/output circuit I/ϕ, FIG. 59 shows the UARC counter, FIG. 60 shows the counter CNTR, FIG. 61 shows the buffer BUFF, and FIG. 62 shows the D circuit.

Finally, attached hereto is a program listing for a program which can be used to update the RAM memory with new information.

```
0312                    ;
0312                    ;------LDA ASCII BLANKS INTO ALL MEMORY----
0312                    ;
0312  A9 1F                 LDA #31
0314  8D 00 40              STA AD6545        ;R31 SELECT
0317  A2 0F                 LDX #$0F
0319  A0 00         LOOP1   LDY #0
031B  AD 00 40      LOC     LDA AD6545        ;STATUS
031E  10 FB                 BPL LOC
0320  A9 20                 LDA #$20          ;ASCII BLANK
0322  8D 03 40              STA LATCH         ;WRITE DATA
0325  C8                    INY
0326  D0 F3                 BNE LOC
```

```
032B  CA                 DEX
0329  10 EE              BPL LOOP1
032B                 :
032B                 :---------LOAD CHARACTER SET---------
032B                 :
032B                 DISP=$0160
032B                 ADDR=$0040
032B                 DATA=$0042
032B                 INDEX=$0043
032B  A9 00              LDA #0
032D  85 42              STA DATA
032F  A2 0F              LDX #$0F
0331  A9 01              LDA #>DISP
0333  85 40              STA ADDR          :UA - HI
0335  A9 60              LDA #<DISP
0337  85 41              STA ADDR+1        :UA - LO
0339  A9 12          L1  LDA #18
033B  8D 00 40           STA AD6545        :R18
033E  A5 40              LDA ADDR
0340  8D 01 40           STA AD6545+1      :UA-HI
0343  A9 13              LDA #19
0345  8D 00 40           STA AD6545        :R19
0348  A5 41              LDA ADDR+1
034A  8D 01 40           STA AD6545+1      :UA - LO
034D  A9 1F              LDA #31
034F  8D 00 40           STA AD6545        :R31 SELECT
0352  A9 0F              LDA #$0F          :NO OF CHARS PER LINE
0354  85 43              STA INDEX
0356  AD 00 40       L2  LDA AD6545        :STATUS
0359  10 FB              BPL L2
035B  A5 42              LDA DATA          :GET CHARACTER
035D  8D 03 40           STA LATCH         :STORE IT IN LATCH
0360  E6 42              INC DATA          :NEXT CHARACTER
0362  C6 43              DEC INDEX
0364  10 F0              BPL L2
0366  18                 CLC               :GET ADDRESS
0367  A5 41              LDA ADDR+1        :OF FIRST LOCATION
0369  69 50              ADC #$50          :OF NEXT LINE
036B  85 41              STA ADDR+1
036D  90 02              BCC L3
036F  E6 40              INC ADDR
0371  CA             L3  DEX
0372  10 C5              BPL L1
```

Item 1 Load Display Memory
(transparent addressing - blanking updates)

```
0312                 :
0312                 :------LDA ASCII BLANKS INTO ALL MEMORY----
0312                 :
0312  A9 1F              LDA #31
0314  8D 00 40           STA AD6545        :R31 SELECT
0317  A2 0F              LDX #$0F
0319  A0 00          LOOP1 LDY #0
031B  A9 20          LOC LDA #$20          :ASCII BLANK
031D  8D 03 40           STA RAM           :WRITE DATA
0320  C8                 INY
0321  D0 FB              BNE LOC
0323  CA                 DEX
0324  10 F3              BPL LOOP1
0326                 :
0326                 :---------LOAD CHARACTER SET---------
0326                 :
0326                 DISP=$0084            :RAM ADDR OF TOP LEFT CHARACTER
0326                 ADDR=$0040
0326                 DATA=$0042
0326                 INDEX=$0043
0326  A9 00              LDA #0
0328  85 42              STA DATA          :FIRST DATA CHARACTER
032A  A2 0F              LDX #$0F          :NO OF ROWS IN BLOCK
032C  A9 00              LDA #>DISP
032E  85 40              STA ADDR          :UA - HI
0330  A9 84              LDA #<DISP
```

```
0332  85 41              STA ADDR+1       :UA - LO
0334  A9 12        L1    LDA #18
0336  8D 00 40           STA AD6545       :R18
0339  A5 40              LDA ADDR
033B  8D 01 40           STA AD6545+1     :UA-HI
033E  A9 13              LDA #19
0340  8D 00 40           STA AD6545       :R19
0343  A5 41              LDA ADDR+1
0345  8D 01 40           STA AD6545+1     :UA - LO
0348  A9 1F              LDA #31
034A  8D 00 40           STA AD6545       :R31 SELECT
034D  A9 0F              LDA #$0F         :NO OF CHARS PER LINE
034F  85 43              STA INDEX
0351  A5 42        L2    LDA DATA         :GET CHARACTER
0353  8D 03 40           STA RAM          :STORE IT IN RAM
0356  E6 42              INC DATA         :NEXT CHARACTER
0358  C6 43              DEC INDEX
035A  10 F5              BPL L2
035C  18                 CLC              :GET ADDRESS
035D  A5 41              LDA ADDR+1       :OF FIRST LOCATION
035F  69 28              ADC #40          :OF NEXT LINE
0361  85 41              STA ADDR+1
0363  90 02              BCC L3
0365  E6 40              INC ADDR
0367  CA           L3    DEX
0368  10 CA              BPL L1
```

Item 2 Load Display Memory
(transparent addressing - $\emptyset_1/\emptyset_2$ interleave)

The embodiments of the invention in which an exclusive property or right is claimed are defined as follows:

1. A controller for cathode ray tubes comprising:
processor terminal means for connecting said controller to a processor;
CRT terminal means for connecting said controller to a cathode ray tube;
refresh address generator means for generating refresh addresses to be connected to a refresh memory so that a display on the CRT can be refreshed;
update address generator means for generating update addresses to the refresh memory so that information within the refresh memory can be updated;
refresh memory terminal means for connecting the update address generator means and the refresh address generator means to the refresh memory; and,
control means for exclusively connecting said update address generator means and said refresh address generator means to said refresh memory terminal means so that only one of said generator means has control of said refresh memory at a time.

2. The controller of claim 1 wherein said update address generator means comprises an update register connected to a character clock terminal means for receiving a character clock signal from said CRT.

3. The controller of claim 2 wherein said update register comprises an update counter having an update output for supplying said update addresses and a clock input for connection to said character clock terminal means.

4. The controller of claim 3 wherein said control means comprises a transistor array connected between said update output and said refresh memory terminal means.

5. The controller of claim 4 wherein said control means comprises mode control register means for selecting the modes of operation for said controller.

6. The controller of claim 5 wherein said mode control register means comprises logic means connected to said transistor array and to phase clock terminal means for receiving a phase clock signal from a processor so that update of said refresh memory can occur during a first half cycle of said phase clock signal and refreshing can occur during a second half cycle.

7. The controller of claim 6 wherein said mode control register means further comprises retrace means connected to said transistor array for updating said refresh memory only during blanking of said CRT.

8. The controller of claim 1 wherein said control means comprises a transistor array connected between said update address generator means and said refresh memory terminal means.

9. The controller of claim 8 wherein said control means comprises mode control register means for selecting the modes of operation for said controller.

10. The controller of claim 9 wherein said mode control register means comprises logic means connected to said transistor array and to phase clock terminal means for receiving a phase clock signal from a processor so that updating of said refresh memory can occur during a first half cycle of said phase clock signal and refreshing can occur during a second half cycle.

11. The controller of claim 10 wherein said mode control register means further comprises retrace means connected to said transistor array for updating said refresh memory only during blanking of said CRT.

12. The controller of claim 1 wherein said control means comprises mode control register means for selecting the modes of operation for said controller.

13. The controller of claim 12 wherein said mode control register means comprises logic means connected to said update and refresh address generator means and to phase clock terminal means for receiving a phase clock signal from a processor so that updating of said refresh memory can occur during a first half cycle of said phase clock signal and refreshing can occur during a second half cycle.

14. The controller of claim 13 wherein said logic means further comprises retrace means for updating said refresh memory only during blanking of said CRT.

15. The controller of claim 1 wherein said refresh address generator means comprises a refresh register connected to a character clock terminal means for receiving a character clock signal from said CRT.

16. The controller of claim 15 wherein said refresh register comprises a refresh counter having a refresh output for supplying said refresh addresses and a clock input for connection to said character clock terminal means.

17. The controller of claim 16 where said update address generator means comprises an update register connected to a character clock terminal means for receiving a character clock signal from said CRT.

18. The controller of claim 17 wherein said update register comprises an update counter having an update output for supplying said update addresses and a clock input for connection to said character clock terminal means.

19. The controller of claim 18 wherein said control means comprises first and second transistor arrays connected between corresponding refresh and update outputs and said refresh memory terminal means.

20. The controller of claim 19 wherein said control means comprises mode control register means for selecting the modes of operation for said controller.

21. The controller of claim 20 wherein said mode control register means comprises logic means connected to said first and second transistor arrays and to phase clock terminal means for receiving a phase clock signal from a processor so that update of said refresh memory can occur during a first half cycle of said phase clock signal and refreshing can occur during a second half cycle.

22. The controller of claim 21 wherein said mode control register means further comprises retrace means connected to said first and second transistor arrays for updating said refresh memory only during blanking of said CRT.

23. The controller of claim 16 wherein said control means comprises a transistor array connected between said update address generator means and said refresh memory terminal means.

24. The controller of claim 23 wherein said control means comprises mode control register means for selecting the modes of operation for said controller.

25. The controller of claim 24 wherein said mode control register means comprises logic means connected to said transistor array and to phase clock terminal means for receiving a phase clock signal from a processor so that updating of said refresh memory can occur during a first half cycle of said phase clock signal and refreshing can occur during a second half cycle.

26. The controller of claim 25 wherein said mode control register means further comprises retrace means connected to said transistor array for updating said refresh memory only during blanking of said CRT.

27. The controller of claim 16 wherein said control means comprises mode control register means for selecting the modes of operation for said controller.

28. The controller of claim 17 wherein said mode control register means comprises logic means connected to said update and refresh address generator means and to phase clock terminal means for receiving a phase clock signal from a processor so that updating of said refresh memory can occur during a first half cycle of said phase clock signal and refreshing can occur during a second half cycle.

29. The controller of claim 28 wherein said logic means further comprises retrace means for updating said refresh memory only during blanking of said CRT.

30. A controller for cathode ray tubes (CRT) comprising:

input terminal means for connecting said controller to a processor;

cathode ray tube terminal means for connecting said controller to a cathode ray tube;

refresh memory terminal means for connecting said controller to a refresh memory;

address generator means connected to said input terminal means, to said cathode ray tube terminal means and to said refresh memory terminal means for generating update addresses to said refresh memory terminal means so that a refresh memory connected to said refresh memory terminal means can be updated with new information and for generating refresh addresses to said refresh memory terminal means so that a refresh memory connected to said refresh address terminal means can be addressed to refresh a display on a cathode ray tube connected to said cathode ray tube terminal means; and, control means connected to said address generator means for controlling said address generator means so that only one of said update address and said refresh address can be connected to said refresh memory terminal means at a time.

31. The controller of claim 30 wherein address generator means comprises refresh address generator means for generating refresh addresses so that said CRT can be refreshed and update address generator means for generating update addresses to said refresh memory terminal means so that information in a refresh memory can be updated and wherein said control means comprises a switching means connected between said update and refresh address generator means and said refresh memory terminal means so that only one of said generator means is connected to said refresh memory terminal means at a time.

32. The controller of claim 31 wherein said control means comprises mode control register means for selecting the modes of operation for said controller.

33. The controller of claim 32 wherein said mode control register means comprises logic means connected to said update and refresh address generator means and to phase clock terminal means for receiving a phase clock signal from a processor so that update of said refresh memory can occur during a first half cycle of said phase clock signal and refreshing can occur during a second half cycle.

34. The controller of claim 33 wherein said mode control register means further comprises retrace means connected to said update and refresh address generator means for updating said refresh memory only during blanking of said CRT.

35. The controller of claim 30 wherein said control means comprises mode control register means for selecting the modes of operation for said controller.

36. The controller of claim 35 wherein said mode control register means comprises logic means connected to said update and refresh address generator means and to phase clock terminal means for receiving a phase clock signal from a processor so that update of said refresh memory can occur during a first half cycle of said phase clock signal and refreshing can occur during a second half cycle.

37. The controller of claim 36 wherein said mode control register means further comprises retrace means connected to said update and refresh address generator means for updating said refresh memory only during blanking of said CRT.

* * * * *